US009687056B2

(12) United States Patent
Sugunan et al.

(10) Patent No.: US 9,687,056 B2
(45) Date of Patent: Jun. 27, 2017

(54) SYSTEMS, DEVICES AND METHODS FOR STYLING HAIR

(71) Applicant: Mirakel Technologies, Inc., Cambridge, MA (US)

(72) Inventors: Suman Lal Chirammal Sugunan, Cambridge, MA (US); Pradeep Paul Panengad, Singapore (SG)

(73) Assignee: Mirakel Technologies, Inc., New York, NY (US)

( * ) Notice: Subject to any disclaimer, the term of this patent is extended or adjusted under 35 U.S.C. 154(b) by 0 days.

(21) Appl. No.: 14/466,656

(22) Filed: Aug. 22, 2014

(65) Prior Publication Data

US 2015/0053227 A1 Feb. 26, 2015

Related U.S. Application Data

(60) Provisional application No. 61/869,337, filed on Aug. 23, 2013.

(51) Int. Cl.
*A45D 24/16* (2006.01)
*A45D 7/04* (2006.01)
(Continued)

(52) U.S. Cl.
CPC ..... *A45D 7/04* (2013.01); *A45D 7/00* (2013.01); *A45D 24/10* (2013.01); *A45D 24/24* (2013.01)

(58) Field of Classification Search
CPC . A45D 1/04; A45D 1/06; A45D 2/001; A45D 6/00; A45D 7/06; A45D 7/04;
(Continued)

(56) References Cited

U.S. PATENT DOCUMENTS 3,851,654 A * 12/1974 Kober ..... A45D 2/36 132/229
3,864,226 A 2/1975 Spitzer
(Continued)

FOREIGN PATENT DOCUMENTS

EP 0796081 B1 9/1997
EP 2197315 A2 6/2010
(Continued)

OTHER PUBLICATIONS

International Search Report and Written Opinion, mailed Dec. 18, 2014 for PCT/US2014/052355, filed Aug. 22, 2014.

*Primary Examiner* — Rachel Steitz
(74) *Attorney, Agent, or Firm* — Cooley LLP

(57) ABSTRACT

An apparatus for styling hair includes a first electrode and a second electrode spaced apart from the first electrode. An electrolyte reservoir can be disposed between the first electrode and the second electrode, and is configured to maintain a volume of an electrolyte between the first electrode and the second electrode. A control module is electrically coupled to the first electrode and the second electrode. The control module is operable to bias the first electrode at a first potential and the second electrode at a second potential to create an electrical potential difference between the first electrode and the second electrode. The electrical potential difference is configured to produce an electrolysis zone in the electrolyte disposed between the first electrode and the second electrode. The electrolysis zone is configured to style hair disposed in the electrolysis zone between the first electrode and the second electrode.

23 Claims, 30 Drawing Sheets

(51) Int. Cl.
*A45D 7/00* (2006.01)
*A45D 24/10* (2006.01)
*A45D 24/24* (2006.01)

(58) Field of Classification Search
CPC ..... A45D 7/045; A45D 2200/202; A45D 2001/008; A45D 24/10; A45D 24/24; A45D 4/06; A45D 4/12; A45D 4/14; A45D 2007/001; A45D 2019/005; A45D 2019/0066
USPC ..... 132/108, 207, 202, 203, 208, 210, 211, 132/212, 272, 142, 221, 219, 245, 228, 132/271, 224, 231, 240, 162, 163, 11, 6, 132/141, 111
See application file for complete search history.

(56) References Cited

U.S. PATENT DOCUMENTS 3,960,160 A * 6/1976 Hogan ..... A45D 24/22 132/112
5,419,344 A 5/1995 DeWitt
5,472,456 A 12/1995 Larsky et al.
5,569,368 A 10/1996 Larsky et al.
5,743,278 A 4/1998 Ookura et al.
5,815,388 A 9/1998 Manley et al.
5,857,379 A 1/1999 Lulofs et al.
6,378,529 B1 * 4/2002 Clemente Marco ... A45D 19/02 132/111
6,588,434 B2 * 7/2003 Taylor ..... A01K 13/002 132/116
6,835,210 B1 12/2004 Bartolone et al.
6,994,733 B2 2/2006 Bartolone et al.
7,178,531 B2 2/2007 Carballada et al.
7,758,269 B2 7/2010 Bailey et al.
8,056,568 B2 11/2011 Ruckart
8,079,373 B2 12/2011 Wyatt
8,596,285 B1 12/2013 Ramaprasad
8,744,567 B2 6/2014 Fassih
2007/0110506 A1 5/2007 Erickson et al.
2007/0239152 A1 10/2007 Trezon
2008/0141467 A1 6/2008 Wood
2008/0142617 A1 * 6/2008 Kasuya ..... B05B 17/0638 239/169
2008/0210251 A1 * 9/2008 Dallianis ..... A45D 24/26 132/116
2011/0118655 A1 5/2011 Fassih et al.
2012/0060860 A1 3/2012 Wyatt et al.
2012/0292196 A1 11/2012 Albrecht et al.
2012/0292197 A1 11/2012 Albrecht et al.
2013/0206606 A1 8/2013 Gilliam et al.

FOREIGN PATENT DOCUMENTS

EP 2197316 A1 6/2010
EP 2498867 A1 9/2012

* cited by examiner

Before

After Combing

After Drying

SYSTEMS, DEVICES AND METHODS FOR STYLING HAIR

CROSS REFERENCE TO RELATED APPLICATIONS

This application claims priority to and benefit of U.S. Provisional Patent Application No. 61/869,337, filed Aug. 23, 2013, and entitled "Systems, Devices and Methods for Styling Hair," the disclosure of which is incorporated by reference herein in its entirety.

BACKGROUND

Embodiments described herein relate generally to devices and methods for styling hair, and in particular, to devices and methods for styling hair using electrolysis.

Hair is made of a protein keratin which is rich in sulfur containing amino acids. The keratin protein matrix in the hair is held together by millions of disulfide bonds that provide the strength and stability of the hair. The disulfide bonds located on the surface of the hair have the maximum leverage in determining the shape of the hair. The distribution of the disulfide bonds with respect to the axis of the hair can dictate the "straightness" or "curliness" of the hair. The disulfide bonds act as a scaffold and can be repositioned to alter the condition and/or orientation of the hair. Conventional methods for styling hair such as, for example, "hair rebonding" and "perming techniques" use heat and/or chemicals to break the disulfide bonds and shape the hair into the desired form, for example, straighten or curl, and subsequently rebond the disulfide bonds, such that the hair retains the reshaped form for some period of time.

Conventional methods that use chemicals and/or heat for styling hair have several disadvantages. For example, the heat and/or chemicals used in conventional hair styling devices and methods can cause significant damage to the hair-root and scalp, can take a long time for the styling operation, and often require the assistance of a professional hair dresser which can be expensive.

Thus there is a need for new hair styling technologies that can allow hair styling without the use of heat and/or chemicals, and can be simple enough to be used by untrained users.

SUMMARY

Embodiments described herein relate generally to devices and methods for styling hair, and in particular, to devices and methods for styling hair using electrolysis. In some embodiments, an apparatus for styling hair includes a first electrode and a second electrode spaced apart from the first electrode. An electrolyte reservoir is disposed between the first electrode and the second electrode. The electrolyte reservoir is configured to maintain a volume of an electrolyte between the first electrode and the second electrode. A control module is electrically coupled to the first electrode and the second electrode. The control module is operable to bias the first electrode at a first potential and the second electrode at a second potential to create an electrical potential difference between the first electrode and the second electrode. The electrical potential difference is configured to produce an electrolysis zone in the electrolyte disposed between the first electrode and the second electrode. The electrolysis zone is configured to style hair disposed in the electrolysis zone between the first electrode and the second electrode. In some embodiments, the electrolyte reservoir can include at least one of a porous material, a sponge, a solid electrolyte, and an electrolyte gel.

BRIEF DESCRIPTION OF DRAWINGS

FIG. 8A is a bottom view while

FIG. 18A is a front view while

FIG. 30A is a perspective view while

FIG. 35A shows a bundle of straight hair while

DETAILED DESCRIPTION

Figure 1:
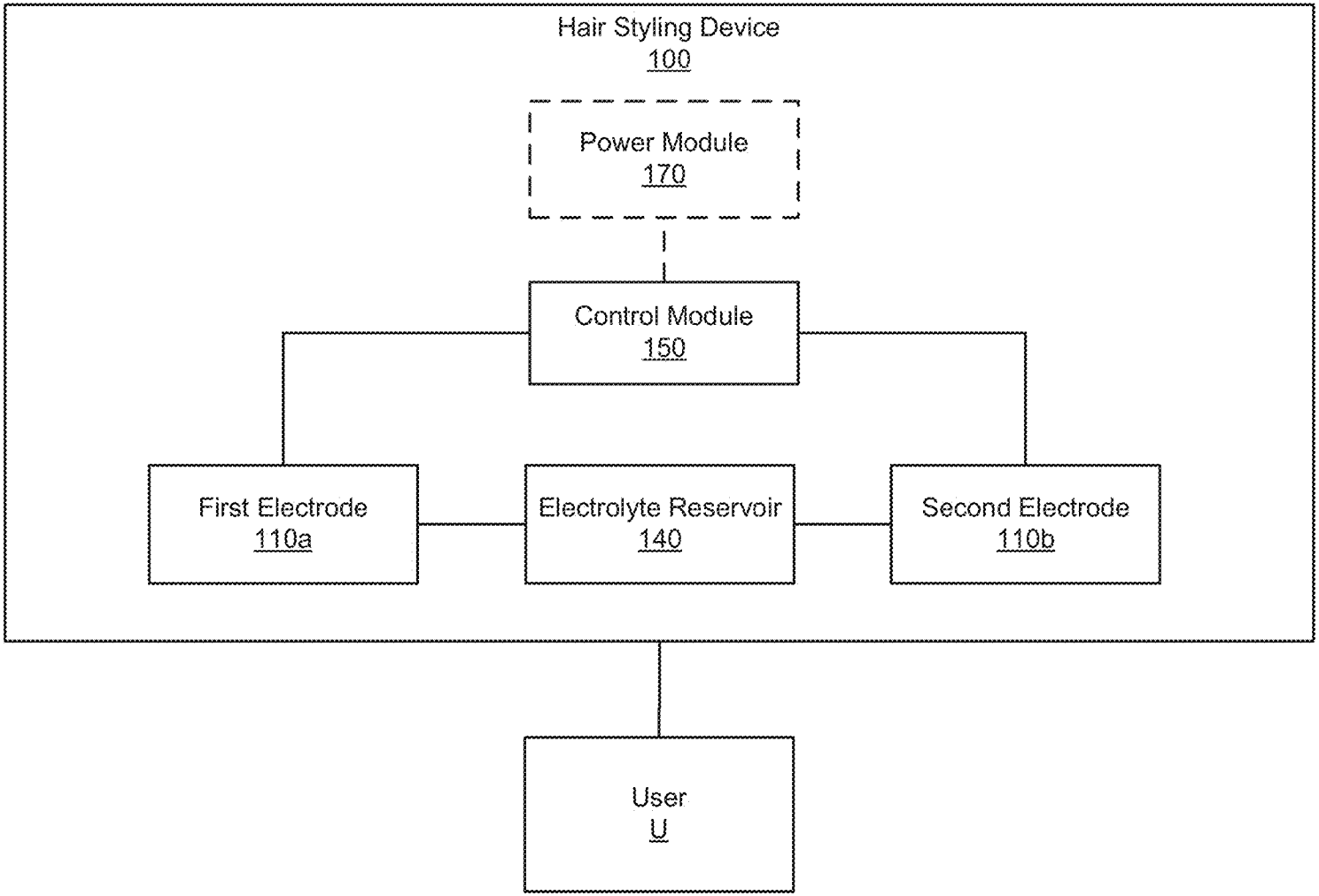
FIG. 1 is a schematic block diagram of an apparatus for styling hair, according to an embodiment.

Embodiments described herein relate generally to devices and methods for styling hair, and in particular, to devices and methods for styling hair using electrolysis. Hair is formed of a matrix of a keratin protein matrix that is held together by millions of disulfide bonds that define the strength and texture of hair. Orientation of these bonds can also define the level of straightness or curliness of the hair. Conventional devices and methods for styling hair, for example, straightening or curling hair, use heat and/or chemicals to break the disulfide bonds, reshape the hair, and subsequently recreate the disulfide bonds such that the hair retains its shape. Such conventional methods that use chemicals and/or heat for styling hair have several disadvantages. For example, the heat and/or chemicals can cause significant damage to the hair-root and scalp, can take a long time, and often require the assistance of a professional hair dresser which can be expensive.

Without wishing to be bound by any theory, it is believed that in some embodiments of the apparatus for styling hair and methods described herein use the high pH generated within an electrolysis zone produced by the apparatus, to break the disulfide bonds of the hair and thereby style the hair. Electrolysis is the process of passing a direct electrical current through a liquid, for example, an aqueous electrolyte. This can be achieved by contacting two electrodes having an electrical potential difference between them, with the liquid and biasing one electrode at a positive and the other at a negative potential to produce the electrical potential difference. At the negatively charged electrode (i.e., the cathode), the water molecules included in the aqueous electrolyte decompose to produce $H^+$ and $OH^-$. The $H^+$ can be consumed by reduction to hydrogen gas such that the region surrounding the cathode, for example, a region within about 300 μm of the cathode has a highly reducing and alkaline pH (e.g., a pH of about 12-14). On the other hand, at the positively charged electrode (i.e., the anode) the water molecules decompose to produce $H^+$ and $OH^-$. The $OH^-$ can be consumed by oxidation to oxygen gas, the free $H^+$ ions combine with a water molecule to produce $H_3O^+$ ions, such that a region proximate to the anode, for example, a region within about 300 μm of the anode has a highly acidic and oxidizing pH (e.g., a pH of about 2-4). When the electric current is removed, the acidic zone and the basic zone around the anode and the cathode disappear almost immediately.

The dense network of the protein keratin that forms hair is bound together by disulfide bonds, hydrogen bonds, and ionic bonds. These bonds, particularly the disulfide bonds can be decomposed in an alkaline and reducing environment, for example, created in an electrolyte near the negative electrode. The disulfide bonds can be urged to reform by oxidation in a neutralizing, or an acidic pH, for example, the acidic and reducing environment created in the electrolyte near the positively charged electrode (i.e., the anode), as described herein. In this manner, the hair can be styled, for example, curved hair can be straightened or any other styling operation described herein can be performed. Without wishing to be bound by any theory, it is believed that exposing the hair to high alkaline pH produced by electrolysis alone is sufficient to achieve breaking of the disulfide bonds and forming of the lanthionization bonds at these sites. In this manner, a broad range of hair styling functions can be performed on hair. For example, embodiments described herein can be used to straighten, curl, attach nanoparticles to, color, moisturize, thicken, control frizz, alter glossiness, deodorize, augment the moldability, add fragrance to, bleach, or highlight hair.

Embodiments of the hair styling device described herein provide several advantages over conventional hair styling devices including, for example: (1) styling hair without the use of heat or chemicals which can damage hair and/or scalp of a user; (2) providing hair that remains styled; (3) performing various hair styling functions, for example, straightening, curling, coloring, moisturizing, highlighting, etc. with a single hair styling device; and (4) simple operation enabling use by untrained users.

In some embodiments, an apparatus for styling hair includes a first electrode and a second electrode spaced apart from the first electrode. An electrolyte reservoir is can be disposed between the first electrode and the second electrode. The electrolyte reservoir is configured to maintain a volume of an electrolyte between the first electrode and the second electrode. A control module is electrically coupled to the first electrode and the second electrode. The control module is operable to bias the first electrode at a first potential and the second electrode at a second potential to create an electrical potential difference between the first electrode and the second electrode. The electrical potential difference is configured to produce an electrolysis zone in the electrolyte disposed between the first electrode and the second electrode. The electrolysis zone is configured to style hair disposed in the electrolysis zone between the first electrode and the second electrode. In some embodiments, the electrolyte reservoir can include at least one of a porous material, a sponge, a solid electrolyte, and an electrolyte gel.

In some embodiments, a method of styling hair with a hair styling device which includes a first electrode, a second electrode spaced apart from the first electrode, and an electrolyte reservoir can be disposed between the first electrode and the second electrode includes disposing hair between the first electrode and the second electrode. A volume of an electrolyte is disposed on at least one of the hair and the electrolyte reservoir. The first electrode is biased at a first potential and the second electrode is biased at a second potential to create an electrical potential difference between the first electrode and the second electrode and to produce an electrolysis zone in the electrolyte disposed between the first electrode and the second electrode. The first electrode and the second electrode are moved with respect to the hair to style hair as it passes through the electrolysis zone between the first electrode and the second electrode.

In some embodiments, a method of styling hair with a hair styling device which includes a first electrode, a second electrode spaced apart from the first electrode, and an electrolyte reservoir can be disposed between the first electrode and the second electrode includes transferring a volume of an electrolyte to the electrolyte reservoir. Hair is disposed between the first electrode and the second electrode. The first electrode is biased at a first potential and the second electrode is biased at a second potential to create an electrical potential difference between the first electrode and the second electrode and to produce an electrolysis zone in the electrolyte disposed between the first electrode and the second electrode. The first electrode and the second electrode are moved with respect to the hair to style hair as it passes through the electrolysis zone between the first electrode and the second electrode.

In some embodiments, an apparatus for styling hair includes a first set of electrodes and a second set of electrodes disposed parallel to and spaced apart from the first set of electrodes. The first set of electrodes and the second set of electrodes are configured to be moved through the hair such that the first set of electrodes moves through the hair first followed by the second set of electrodes. A control module is electrically coupled to the first set of electrodes and the second set of electrodes. The control module is operable to bias the first set of electrodes at a first potential and the second set of electrodes at a second potential to create an electrical potential difference between the first set of electrodes and the second set of electrodes. The electrical potential difference is configured to produce an electrolysis zone in an electrolyte disposed between the first set of electrodes and the second set of electrodes, and to style hair disposed between the first set of electrodes and the second set of electrodes. In some embodiments, an electrolyte reservoir is disposed between the first set of electrodes and the second set of electrodes. The electrolyte reservoir is configured to maintain a volume of an electrolyte between the first set of electrodes and the second set of electrodes.

In some embodiments, a method of styling hair with a hair styling device which includes a first set of electrodes, a second set of electrodes disposed parallel to and spaced apart from the first set of electrodes, and an electrolyte reservoir disposed between the first set of electrodes and the second set of electrodes includes disposing hair between the first set of electrodes and the second set of electrodes. A volume of an electrolyte is maintained between the first set of electrodes and the second set of electrodes. The first set of electrodes are biased at a first potential and the second set of electrodes are biased at a second potential to create an electrical potential difference between the first set of electrodes and the second set of electrodes and to produce an electrolysis zone in the electrolyte. The first set of electrodes and the second set of electrodes are moved through the hair such that the first set of electrodes move through the hair first followed by the second set of electrodes to style the hair as it passes through the electrolysis zone between the first set of electrodes and the second set of electrodes.

As used herein, the singular forms "a," "an", and "the" include plural referents unless the context clearly dictates otherwise. Thus, for example, the term "a member" is intended to mean a single member or a combination of members, "a material" is intended to mean one or more materials, or a combination thereof.

As used herein, the terms "about" and "approximately" generally mean plus or minus 10% of the value stated. For example, about 0.5 would include 0.45 and 0.55, about 10 would include 9 to 11, about 1000 would include 900 to 1100.

FIG. 1 shows a schematic illustration of an apparatus 100 for styling hair according to an embodiment. The apparatus 100 includes a first electrode 110*a*, a second electrode 110*b*, an electrolyte reservoir 140, a control module 150, and optionally, a power module 170.

The first electrode 110*a* and the second electrode 110*b* (collectively referred to as the "electrodes 110") are configured to engage the hair of the user U and style the hair using electrolysis. The second electrode 110*b* is spaced apart from the first electrode 110*a*, for example, disposed parallel to or adjacent to the first electrode 110*a* such that a space exists between the first electrode 110*a* and the second electrode 110*b*. In some embodiments, the first electrode 110*a* can be polarized at a negative potential and serve as a cathode and the second electrode 110*b* can be polarized at a positive potential and serve as an anode. In this configuration, the first electrode 110*a* produces an alkaline and reducing zone proximate to the first electrode 110*a* and the second electrode 110*b* produces an acidic and oxidizing zone proximate to the second electrode 110*b*, when the electrodes 110 are polarized in an electrolyte, for example, an electrolyte maintained between electrodes 110 by the electrolyte reservoir 129, as described herein. In some embodiments, the polarity can be reversed such that the first electrode 110*a* is now the anode and the second electrode 110*b* is the cathode. The electrolysis zone (i.e. the reducing zone and/or the oxidizing zone) can be highly localized to the surface of the electrodes 110, for example, the electrolysis zone can be spread within a distance of about 300 μm from the surface of the electrodes 110. The electrodes 110 can be made of a conductive material, for example, aluminum, copper, stainless steel, alloys, other metals, ceramics, graphite any other suitable conductive material, and or a combination thereof. In some embodiments, the electrodes 110 can also be coated with a corrosion resistant material, for example, gold, platinum, aluminum, any other corrosion resistant material or combination thereof.

In some embodiments, the electrodes 110 can include a plurality of electrodes. For example, the apparatus 100 can include a first set of electrodes 110*a* of one polarity and a second set of electrodes 110*b* of a second polarity disposed parallel to and spaced apart from the first set of electrodes 110*a*. In such embodiments, the first set of electrodes 110*a* and the second set of electrodes 110*b* can be configured to be moved through the hair such that the first set of electrodes 110*a* moves through the hair first followed by the second set of electrodes 110*b*. For example, each of the first set of electrodes 110*a* and the second set of electrodes 110*b* can include a plurality of teeth (e.g., combs) configured to slide through hair (i.e., comb the hair). Although described as being disposed in rows parallel to each other, in some embodiments, the teeth of the first set of electrode s 110*a* and the second set of electrodes 110*b* can be disposed in series, for example a single row of electrodes may have a tooth of the first set of electrodes 110*a* can be disposed adjacent to a tooth of the second set of electrodes 110*b*, typically with an insulating tooth between teeth of different polarities. In some embodiments, either the first electrode 110*a* or the second electrode 110*b* can include teeth which are configured to contact the hair of the user U. The other electrode (e.g., the first electrodes 110*a* or the second electrodes 110*b*) can be disposed in a second electrolyte reservoir, as described herein such that the electrode disposed in the second electrolyte reservoir does not contact the hair but still completes the electronic circuit. In such embodiments, for example, the electrolyte can flow along the teeth of the set of electrodes in contact with the hair such that the electrolysis zone is in vicinity of the hair. The user U can use the apparatus 100 to comb the hair such that electrolysis zone can be used to style the hair as the user U combs the hair.

In some embodiments, a first set of guard combs (not shown) can be disposed adjacent to the first set of electrodes 110*a* and a second set of guard combs (not shown) (collectively referred to as "the set of guard combs") can be disposed adjacent to the second set of electrodes 110*b*. The set of guard combs can be formed from an insulating material, for example, plastic, polycarbonate, wood, or any other suitable insulating material. The first set of guard combs and the second set of guard combs can each be configured to prevent the first set of electrodes and the second set of electrodes from contacting the user. For example, each of the set of guard combs can also include a plurality of teeth. The teeth of the set of guard combs can be aligned with the teeth of the set of electrodes 110 such that the hair can easily slide between the teeth of each of the set of electrodes and the teeth of the set of guard combs. The teeth of the set of guard combs can be longer than the teeth of the set of electrodes 110 such that only the teeth of the second set of combs contact the scalp of the user U. Thus the electrodes 110 and (and hence the electrolysis zone) never comes in contact with the scalp of the user U. In some embodiments, the set of guard combs can be disposed parallel to the set of electrodes 110. In some embodiments, the set of electrodes 110 and the set of guard combs can be arranged in a single row, for example, the set of guard combs can be disposed alternately with the set of electrodes 110 and flanking a pair of teeth of the set of electrodes 110.

In some embodiments, any one of the electrodes 110, for example, the first electrode 110*a*, can be substantially cylindrical (e.g., having a circular cross-section). In some embodiments, the second electrode 110*b* can be a hollow cylinder, shaped and sized to coaxially slide over the first electrode 110*a* such that a gap remains between the first electrode 110*a* and the second electrode 110*b*. In such embodiments, the hair of the user U can be wrapped over the first electrode 110*a* and the second electrode 110*b* can then be disposed over the first electrode 110*a*, such that the hair is disposed between the first electrode 110*a* and the second electrode 110*b*. Current can be passed in the presence of the electrolyte, to perform electrolysis to curl the hair. In some embodiments, the coaxial electrodes 110 can be immersed in an electrolyte. In some embodiments, the electrolyte can be sprayed on the hair of the user beforehand. In some embodiments, the first electrode 110*a* can be in the form of a cylinder and the second electrode 110*b* can be in the form of a ribbon electrode. The user U can wrap the hair around the first electrode 110*a* and then wrap the second electrode 110*b*, i.e. the ribbon electrode around the hair. In the presence of the electrolyte, electrolysis can be performed to style (e.g., curl) the hair. In some embodiments, the electrodes 110 can be in the form of a pair of flat plates. In such embodiments, the electrolyte reservoir 129 can be disposed on one or both of the flat plates and can be configured to maintain the electrolyte between the pair of flat plates. In some embodiments, the hair styling device 100 can include a suction mechanism, for example, a vacuum to draw the hair into a space between the electrodes 110 to style the hair. In some embodiments, the electrodes 110 can be in the form of a roller brush.

In some embodiments, the electrolyte reservoir 129 can be disposed between the first electrode 110*a* and the second electrodes 110*b* (e.g., between the first set of electrodes and the second set of electrodes). The electrolyte reservoir 129 is configured to maintain a volume of the electrolyte between the first electrode 110*a* and the second electrode 110*b*. As described herein, the electrolysis zone is produced in the electrolyte because of the electronic current which passes between the polarized electrodes 110 through the electrolyte. Therefore, to ensure that the electrolysis zone is produced in the space between the electrodes 110, at least a minimum volume of the electrolyte should be maintained between the electrodes 110 during the hair styling operation. The electrolyte 129 reservoir thus ensures that there is a sufficient volume of the electrolyte is maintained between the first electrode 110*a* and the second electrode 110*b* such that an uninterrupted electrolysis zone is produced between the electrodes 110 during the styling operation. In some embodiments, the electrolyte reservoir 129 can include a porous material, for example, a sponge, a solid electrolyte or an electrolyte gel. In some embodiments, the hair styling device 100 can also include a frame (not shown) which can include features to house the electrolyte reservoir 129. The frame can be formed from any suitable material such as, for example, a plastic or polycarbonate frame and can also be configured to house at least a portion of the electrodes 110 or otherwise set of electrodes 110, and/or the set of guard combs. In some embodiments, the electrolyte reservoir 129 can be disposed between the first electrode 110*a* and the second electrode 110*b* (e.g., the first set of electrodes 110*a* and the second set of electrodes 110*b*).

In some embodiments, the electrolyte reservoir 129 can be a first electrolyte reservoir 129, and the apparatus 100 can also include a second electrolyte reservoir (not shown) configured to contain a volume of the electrolyte. The second electrolyte reservoir can be configured to be fluidically coupled to the first electrolyte reservoir 129 and to transfer at least a portion of the electrolyte to the first electrolyte reservoir. For example, the second electrolyte reservoir can include any suitable container for containing the electrolyte to be communicated to the first electrolyte reservoir 129. In some embodiments, the second electrolyte reservoir can be removably coupled to the apparatus 100, for example, removably coupled to the frame via clamps, clips, a snap-fit mechanism, a friction fit mechanism, screws, VELCRO®, or any other suitable coupling mechanism.

In some embodiments, the apparatus can include a supply mechanism configured to transfer the electrolyte from the first electrolyte reservoir 129 to the second electrolyte reservoir. In some embodiments, the supply mechanism can be configured to transfer at least a portion of the electrolyte from the first electrolyte reservoir to the second electrolyte reservoir in response to gravitational force. In some embodiments, the supply mechanism can be configured to transfer at least a portion of the electrolyte from the first electrolyte reservoir to the second electrolyte reservoir in response to a capillary force. In some embodiments, the supply mechanism can include a pumping mechanism configured to transfer at least a portion of the electrolyte from the first electrolyte reservoir 129 to the second electrolyte reservoir. In some embodiments, the pumping mechanism can include a manual pumping mechanism such as, for example, a hand pump, a hand syringe pump, a bubble pump, a gas pump, etc. In some embodiments, the pumping mechanism can include an electrical pumping mechanism such as, for example, a micropump, a peristaltic pump, an electric syringe pump, or any other electric pumping mechanism. In some embodiments, the pumping mechanism can include an automated pumping mechanism. For example, the pumping mechanism can include sensors (e.g., flow sensors, or liquid level sensors) to determine a volume of the liquid disposed in the first electrolyte reservoir 129 and/or maintained between the first electrode 110*a* and the second electrode 110*b* by the first electrolyte reservoir 129. In some embodiments, an electronic parameter (e.g., a current passed through the electrolyte, or a resistance of electrolyte) can be used to determine a volume of the liquid disposed in the first electrolyte reservoir 129 and/or maintained between the first electrode 110*a* and the second electrode 110*b* by the first electrolyte reservoir 129. In such embodiments, the pumping mechanism can include a feedback mechanism or control mechanism to analyze the sensor data to determine if the volume of the liquid disposed in the first electrolyte reservoir and/or maintained between the first electrode 110*a* and the second electrode 110*b* is within or below a certain threshold. If the volume of the electrolyte is below the predetermined threshold, the automated pumping mechanism can be configured to fluidically communicate at least a portion of the electrolyte from the second electrolyte reservoir to the first electrolyte reservoir 129, and between the electrodes 110 therefrom. In this manner, a volume of the electrolyte above a predetermined threshold can be maintained between the electrodes in an automated manner.

The electrolyte can be a solution of water and a salt. The salt can be any suitable salt which is safe for human consumption, for example, sodium bicarbonate, sodium chloride, sodium carbonate, sodium sulfate, sodium iodide, magnesium sulfate, magnesium chloride, calcium chloride, potassium chloride, potassium iodide, potassium sulfate, potassium bicarbonate, potassium carbonate, sodium acetate, sodium citrate, sodium phosphate, chromium chloride, aluminum chloride, Epsom salt, any other suitable salt or combination thereof. In some embodiments, the electrolyte can be formulated to contain any organic polymer molecules, for example, polyvinyl alcohol, polyethylene glycol, starch, dextran, sulfate, polypyrrolidone, Ficoll, any proteins, DNA, etc. In some embodiments, a non-aqueous salt solution can be used. For example, any one of the salts mentioned herein, or any other suitable salt can be dissolved in an organic solvent, for example, ethanol, methanol, acetone, isopropanol, tetrahydrofuran, dimethyl sulfoxide, or any other suitable organic solvent to form a non-aqueous salt solution. In such embodiments, the non-aqueous salt does not conduct electricity but when the non-aqueous salt solution contacts hair which has been moisturized with an aqueous moisturizer, the salt in the non-aqueous salt solution can dissolve in the moisturizer encapsulating the hair to form an aqueous electrolyte in situ. This aqueous electrolyte can subsequently be electrolyzed by the electrodes 110 for styling the hair. These components may have specific roles or general roles like altering the viscosity, conductivity and surface tension of the electrolyte. In some embodiments, the electrolyte can include metallic, graphite, or any other conductive particles of varying dimension that improve conductivity and reduce the electrical resistance of the electrolyte solution. In some embodiments, the electrolyte can include acidic, basic or neutral buffer salts to modulate/fine tune the effect of electrolysis on the hair. In some embodiments, any kind of solution, an electrolyte or a powder of conducting material can be applied, for example, sprayed on or dusted, on the hair before using the apparatus 100, to reduce the electrical resistance of the hair as well as to alter the moisture level in the hair. In some embodiments, the electrolyte can include additives, for example, a sulfhydryl group, such that the additives can be incorporated into the hair of the user U via oxidation to a disulfide bond by the electrolytic action of the apparatus 100. For example, the electrolyte can include nanoparticles (e.g., fluorescent nanoparticles), dyes (e.g., one or more pigments), moisturizing polymers (e.g., polyvinyl alcohol with $OH^-$ groups), thickeners (e.g., polymer conjugated micro-particles), fizz control agents (e.g., oils), glossiness agents (e.g., polyvinyl conjugated fatty acids), deodorants (e.g., polymer with multiple COOH groups), hair molding agents (e.g., castor oil and other long chain fatty acids), fragrance, or any combination thereof. In some embodiments, sodium chloride can be included as the salt in the electrolyte, such that chlorine is produced at the anode which can be used to bleach the hair. In some embodiments, only a portion of the electrodes 110 can be polarized to perform electrolysis such that the apparatus 100 can be used for highlighting. In some embodiments, the hair styling device 100 can include a plurality of second electrolyte reservoirs removably coupleable to the apparatus 100. Each electrolyte can include a different formulated for performing a different styling operation, as described herein. In this manner, the apparatus 100 can be used to perform a variety of hair styling operations by simply replacing the second electrolyte reservoir with another which includes the electrolyte suitable for performing the desired hair styling operation.

The control module 150 is electrically coupled to the first electrode 110*a* and the second electrode 110*b*. The control module 150 is operable to bias the first electrode 110*a* at a first potential and a second electrode 110*b* at a second potential to create an electrical potential difference between the first electrode 110*a* and the second electrode 110*b*. The electrical potential difference is configured to produce an electrolysis zone in the electrolyte disposed between the first electrode 110*a* and the second electrode 110*b*. The electrolysis zone is configured to style hair disposed in the electrolysis zone between the first electrode 110*a* and the second electrode 110*b*. In some embodiments, the control module 150 can be operable to adjust a magnitude of at least one of the first potential and the second potential to adjust an intensity of the electrolysis zone. In some embodiments, the control module 150 is operable to reverse a polarity of the first potential and the second potential. In some embodiments, the control module 150 can include a variable resistor (not shown), for example, a rheostat or potentiometer, and a directional switch, for example, a DPDT switch (not shown). The variable resistor can, for example, be a dial type resistor that can be used to manually adjust the potential difference across the electrodes 110 such that the intensity of electrolysis can be controlled. The directional switch can be used to reverse or change the polarity on the first electrode 110*a* and the second electrode 110*b* such that any one of the first electrode 110*a* or the second electrode 110*b* can be used as the anode or the cathode. This can enable the user U to use the apparatus 100 either left handed or right handed. In some embodiments, the polarity of the electrodes 110 can be configured such that the anode is disposed on the advancing side based on the direction of motion of the apparatus 100.

Such embodiments, for example, can be useful in reversing any hair styling function performed previously using the same apparatus 100 (e.g., strip of coatings or additions made on the hair using the same apparatus 100).

In some embodiments, the apparatus 100 can optionally include a power module 170. The power module 170 can be coupled to the control module 150 and can include a power source for supplying electric power for the electrolysis reaction. In some embodiments, the power module 170 can include a plurality of rechargeable batteries, for example, li-ion coin cells, 9 volt cells, D cells, or any other suitable cells, disposed in series within a sealed container, for example, a cylindrical container to form the power source (not shown). In some embodiments, the power source can be configured to deliver an electrical output of about 45 volt and about 260 mA. In some embodiments, the power source can be a 24 volt 5 amp power source. In some embodiments, the power source can be a 24 volt 4 amp power source. In some embodiments, the power source can be a 24 volt 3 amp power source. In some embodiments, the power source can be a 12 volt 5 amp power source. In some embodiments, the power source can be a 12 volt 4 amp power source. In some embodiments, the power source can be a 12 volt 3 amp power source. In some embodiments, the power source can include capacitors. In some embodiments, the power source can include a magnetic field fluctuation producing source that may induce electric current and electrolysis in the hair. In some embodiments, electrical power can be delivered directly from electrical mains to the control module 150 such that the power module 170 is not required. In such embodiments, an external power supply can be used to provide electrical power to the control module 150 via cords or wires and regulate the voltage and/or current input into the control module.

The power module 170 can also include a housing (not shown) to house the power source. In some embodiments, the power module 170 housing can be in the form of a hollow cylinder that is sealed using end caps (not shown). At least one of the end caps can include electrical couplings for coupling the power module 170 to the control module 150. At least one of the end caps can also include a plurality of switches such that, the switches can be toggled in a predetermined combination for power supply from battery, battery charging, or direct power supply from external source, for example, a docking unit.

In use, the hair or a user U can be disposed between the first electrode 110*a* and the second electrode 110*b*, for example, the first set of electrodes 110*a* and the second set of electrodes 110*b*. A volume of the electrolyte can be disposed on at least one of the hair and the electrolyte reservoir 129. For example, the electrolyte can be sprayed onto the hair and/or can be maintained between the electrodes 110 by the electrolyte reservoir 129. The first electrode 110*a* can be biased at a first potential (e.g., a positive potential) and the second electrode can be biased at a second potential (e.g., a negative potential). This can create an electrical potential difference between the first electrode 110*a* and the second electrode 110*b* to produce an electrolysis zone between the first electrode 110*a* and the second electrode 110*b*. The first electrode 110*a* and the second electrode 110*b* can be moved with respect to the hair to style the hair as it passes through the electrolysis zone between the first electrode 110*a* and the second electrode 110*b*. In some embodiments, the first electrode 110*a* can be moved through the hair first followed by the second electrode 110*b* such that the hair is exposed to the electrolysis zone of the first electrode 110*a* followed by the electrolysis zone of the second electrode 110*b*. In some embodiments in which the electrolyte reservoir 129 is a first electrolyte reservoir 129, and the apparatus includes the second electrolyte reservoir, a replenishing volume of an electrolyte can be fluidically communicated from the second electrolyte reservoir to the first electrolyte reservoir 129 (e.g., via gravity, capillary flow, or any other pumping mechanism described herein).

Having described above various general principles, several exemplary embodiments of these concepts are now described. These embodiments are only examples, and many other configurations of apparatus for styling hair using electrolysis are envisioned.

Figure 2:
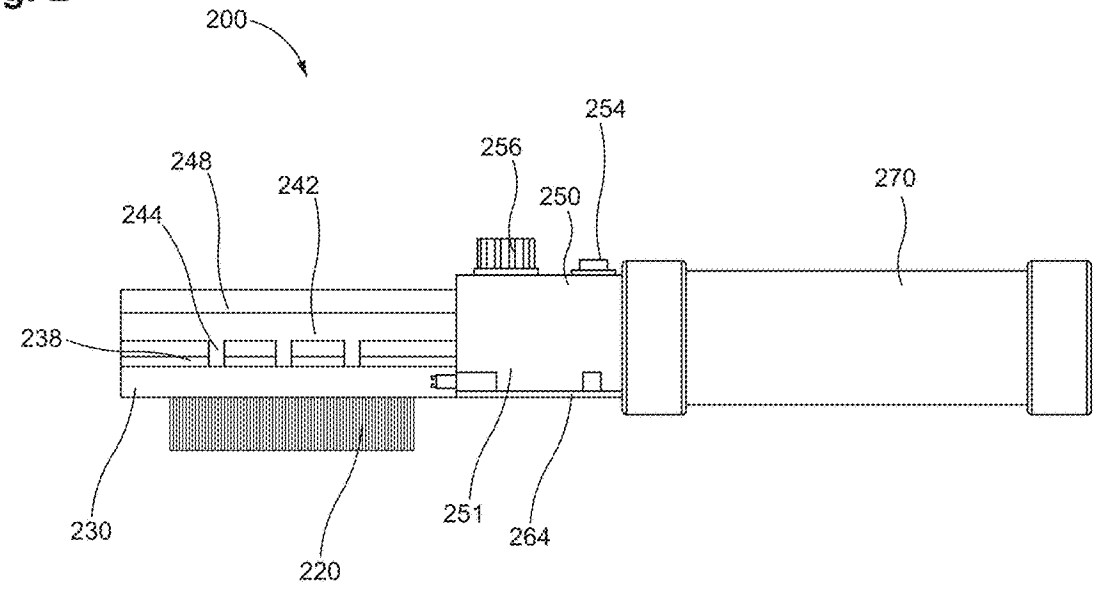
FIG. 2 is a side view of an apparatus for styling hair, according to an embodiment.
Figure 3:
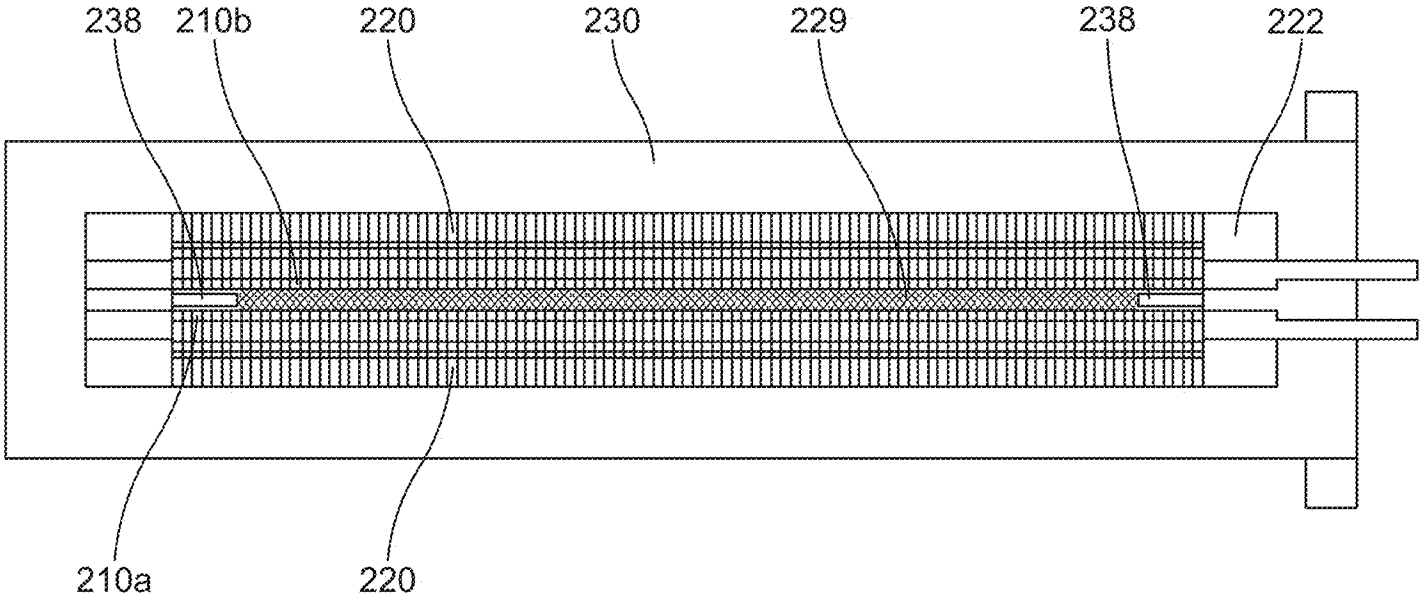
FIG. 3 is a bottom view of a portion of the apparatus of FIG. 2.

In some embodiments, an apparatus for styling hair can include a first set of electrodes and a second set of electrodes. Referring now to FIGS. 2 and 3, an apparatus 200 that uses electrolysis for styling hair includes a first set of electrodes 210*a* and a second set of electrodes 210*b* (collectively referred to as the "set of electrodes 210" or the "electrodes 210") which include a plurality of teeth. In certain embodiments, the teeth of one polarity, e.g., the anodes, and the teeth of a second polarity, e.g., the cathodes, can be arranged in spaced parallel rows with the anode rows having no cathodes and the cathode rows having no anodes. In other embodiments in which a row may include electrodes of both cathodes and anodes, an insulating tooth may be provided between teeth of different polarities. The set of electrodes 210 are flanked by a set of guard combs 220 (FIG. 3). As shown in FIGS. 2 and 3, the apparatus 200 further includes a frame 230, a first electrolyte reservoir 229, a second electrolyte reservoir 240, a control module 250, and a power module 270. In some embodiments, a first electrolyte reservoir 229, a second electrolyte reservoir 240 may be omitted. FIG. 3 shows a bottom view of the electrodes 210 and the guard combs 220 disposed in the frame 230. The first set of electrodes 210*a* and the second set of electrodes 210*b* are essentially mirror images of each other.

Figure 4:
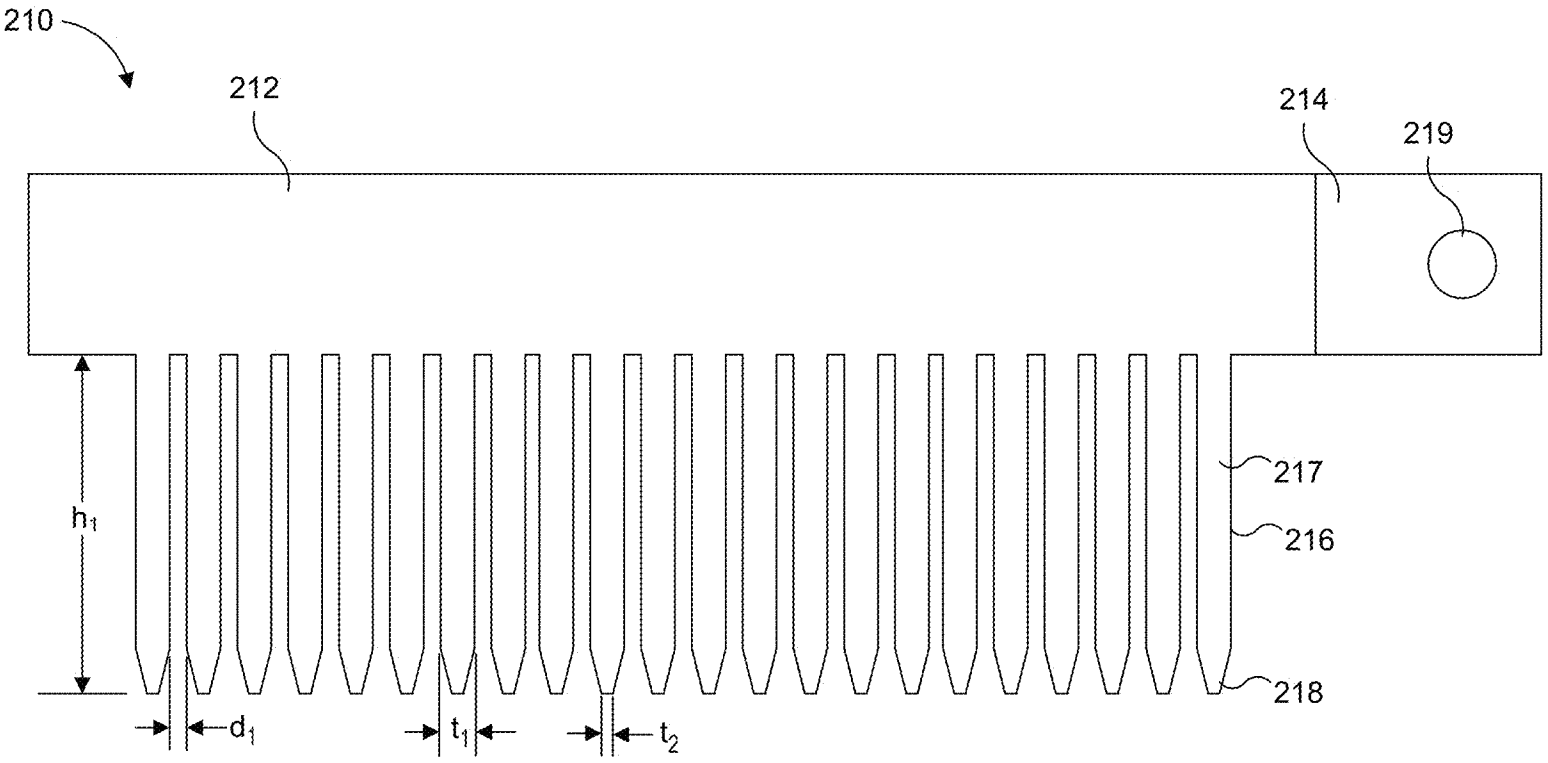
FIG. 4 is a side view of an electrode included in the apparatus of FIG. 2.
Figure 5:
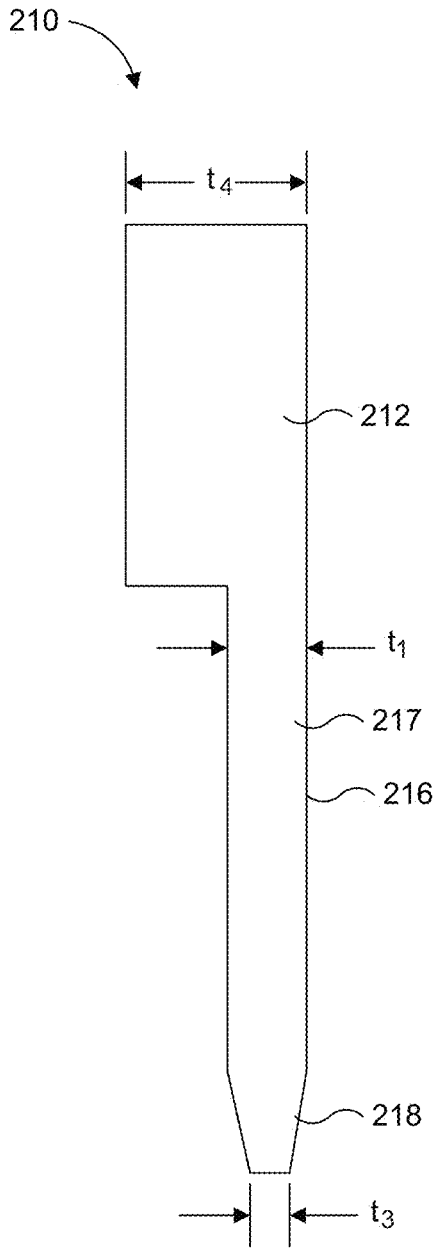
FIG. 5 is a front view of the electrode of FIG. 4.

Referring now also to FIGS. 4 and 5, each of the set of electrodes 210 includes a first portion 212 and a second portion 214. The first portion 212 includes a plurality of teeth 216 disposed at a base of the first portion 212, which are sized and shaped to be used as a comb by a user to style hair by combing the hair. At least a section of the first portion 212 and a section of the second portion 214 are disposed in the frame 230, as described herein. Each of the plurality of teeth 216 has a height $h_1$, and an inter teeth spacing of $d_1$. In some embodiments, the height $h_1$ of each of the plurality of teeth 216 can be, for example, in the range of about 10 mm to about 20 mm (e.g., about 11 mm, 12 mm, 13 mm, 14 mm, 15 mm, 16 mm, 17 mm, 18 mm, or about 19 mm, inclusive of all ranges and values therebetween). In some embodiments, the inter teeth spacing $d_1$ can be, for example, about 0.5 mm. 0.4 mm, 0.3 mm, 0.2 mm, or about 1 mm, inclusive of all ranges and values therebetween. Each of the plurality of teeth 216 can include a first portion 217 and a second portion 218. In some embodiments, the first portion 217 of the teeth 216 can have a circular, square, rectangular, pentagonal, hexagonal, octagonal, elliptical, or any other suitable cross-section. In some embodiments, the first portion 217 of the teeth 216 can have a square cross section which defines a width $t_1$, for example, in the range of about 1 mm to about 3 mm (e.g., about 2 mm). The second portion 218 of the teeth 216 can be a beveled tip which, in some embodiments, can be rectangular in shape and have, for example, a length $t_2$ of about 1 mm, and a width $t_3$ of about 2 mm.

The first portion 212 can have a width $t_4$, for example, of in the range of about 2 mm to about 4 mm (e.g., about 3 mm). The second portion 214 can have a width which is less than the width of the first portion 212. The second portion 214 defines an aperture 219, for example to provide an electrical coupling with the control module 250, for example, using screws, bolts, a latch mechanism, a snap-fit mechanism, or any other suitable coupling mechanism.

Each of the first set of electrodes 210*a* and the second set of electrodes 210*b* can be formed from a suitable conductive material, for example, aluminum, copper, stainless steel, alloys, other metals, ceramics, graphite, any other suitable conductive material, or combination thereof. The set of electrodes 210 can be formed using any suitable manufacturing step, for example, molding, casting, stamping, powder press forming, or any other suitable manufacturing process. Although the first set of electrodes 210*a* and the second set of electrodes 210*b* are shown in FIG. 3 as being disposed in rows parallel to each other, in some embodiments, the set of electrodes 210 can be disposed in a single row. For example, a first tooth can be included in the first set of electrodes 210*a* and a second tooth can be included in the second set of electrodes 210*b*, and then the pattern can repeat. In such embodiments, an insulating tooth can be disposed between adjacent electrodes 210*a* and electrodes 201*b* of different polarity.

Referring back to FIG. 3, the first electrolyte reservoir 229 is disposed between the first set of electrodes 210*a* and the second set of electrodes 220*b*. The first electrolyte reservoir 229 is configured to maintain a volume of an electrolyte between the first set of electrodes 210*a* and the second set of electrodes 210*b*. As shown in FIG. 3, the first electrolyte reservoir 229 can include a sponge configured to hold an electrolyte and communicate the electrolyte between the set of electrodes 210. For example, when a user combs hair, the first electrolyte reservoir 229 can be compressed thereby expelling the electrolyte contained therein into the space between the set of electrodes 210. While described as including a sponge, the first electrolyte reservoir 229 can include any suitable electrolyte reservoir such as, for example, a porous material, a solid electrolyte, or an electrolyte reservoir. The surfaces of the first electrolyte reservoir 229 in contact with the set of electrodes 210 can be laminated with a non-conductive material to prevent current from passing through the first electrolyte reservoir 229. The width of the first electrolyte reservoir 229 proximal to the second portion 218 of the teeth 216 of the set of electrodes 210 can be slightly smaller than the distance between the set of electrodes 210 to ensure free compression and expansion of the first electrolyte reservoir 229 when a user combs the hair. The width of the first electrolyte reservoir 229 proximal to the first portion 212 of the electrode 210 can be slightly larger than the distance between the electrodes 210 to prevent the slipping of the first electrolyte reservoir 229 from between the electrodes 210. In some embodiments, the inter teeth spacing $d_1$ of the set electrodes 210 can be configured such that the electrolyte can fill the inter teeth spacing and remain therein, because of surface tension such that the first electrolyte reservoir 229 is not required. In such embodiments, the electrolyte can be sprayed on the hair before styling the hair with the apparatus 200, or can be communicated to the space between the electrodes by the second electrolyte reservoir 240, as described herein.

Figure 6:
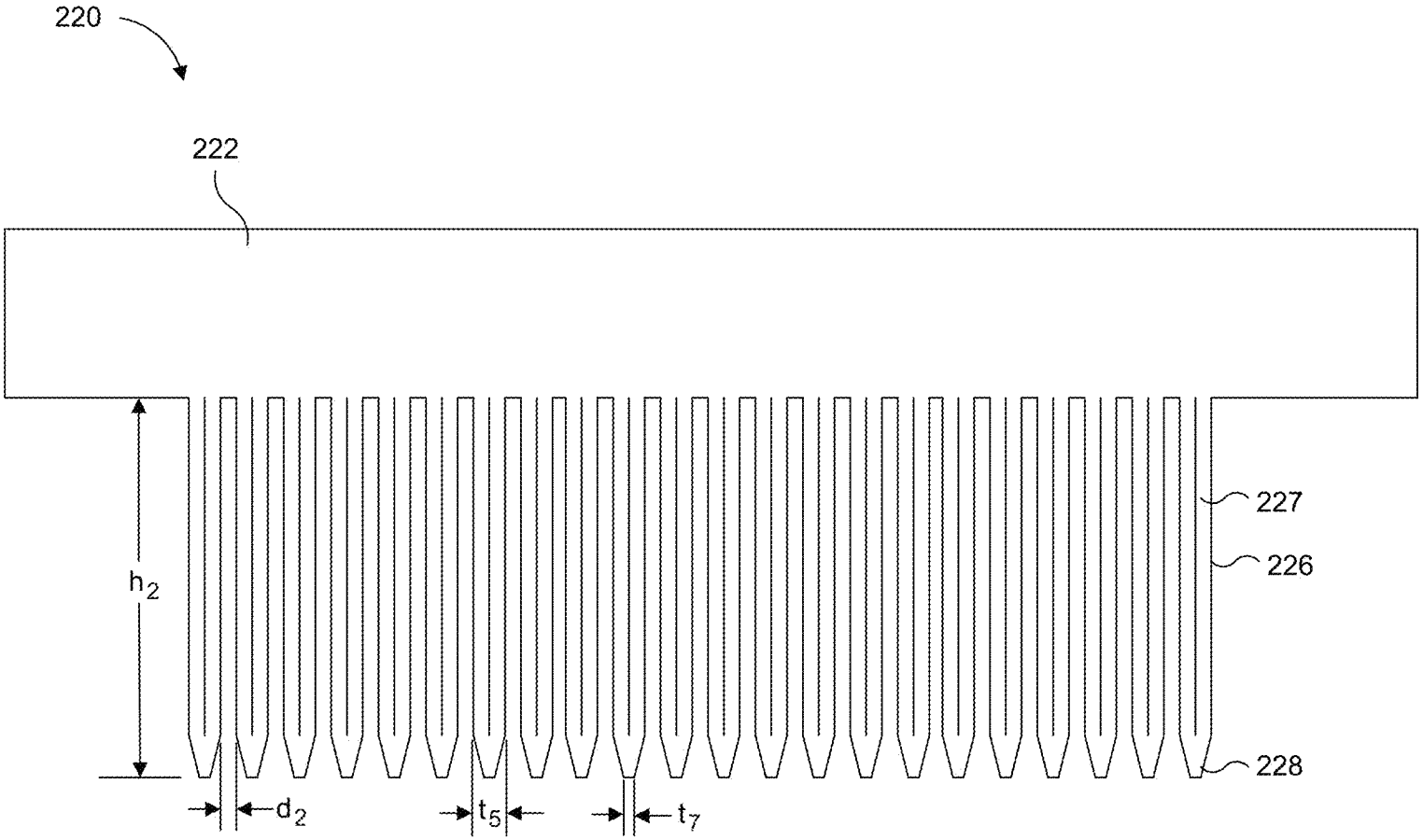
FIG. 6 is a side view of a guard comb included in the apparatus of FIG. 2.
Figure 7:
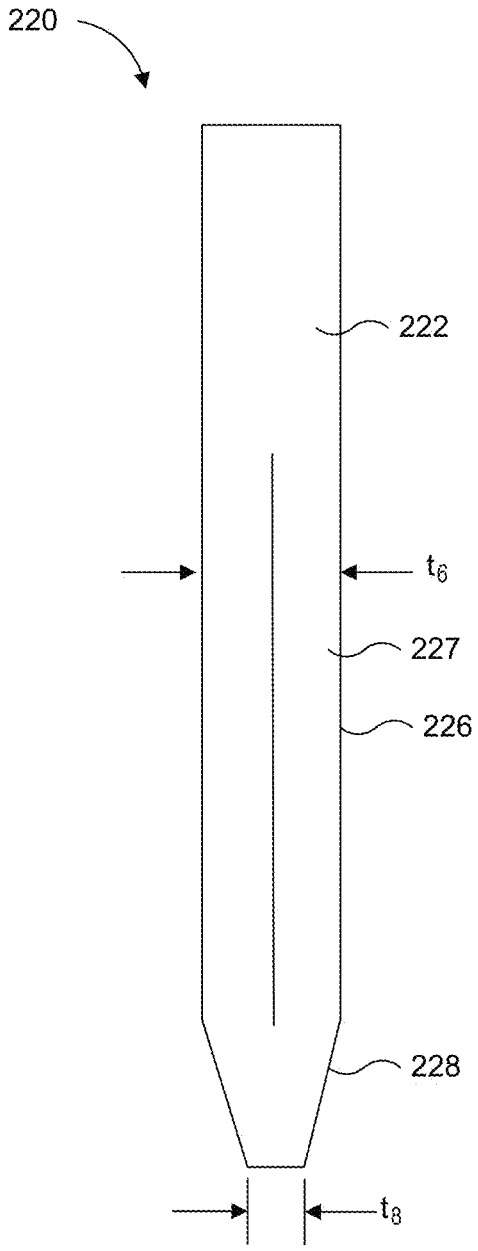
FIG. 7 is a front view of the guard comb of FIG. 6.

Referring also now to FIGS. 6-7, the set of guard combs 220 are disposed adjacent to the electrodes 210, such that the electrodes 210 are flanked by the guard combs 220. The set of guard combs 220 includes a first set of guard combs disposed adjacent to the first set of electrodes 210*a* and a second set of guard combs adjacent to the second set of electrodes 210*b*.

The set of guard combs 220 can have an inter teeth spacing $d_2$, for example, of about 0.5 mm, or about 1 mm. Each of the plurality of teeth 226 can include a first portion 227 and a second portion 228. The first portion 227 can have a pentagonal cross section such that the side wall of the guard combs 220 resembles a wedge. The first portion 227 can have a length $t_5$, for example, of about 3 mm, and a width $t_6$, for example, in the range of about 2 mm to about 4 mm (e.g., about 3 mm). In some embodiments, the first portion can have a square, rectangular, circular, hexagonal, octagonal, or any other suitable cross section. The second portion 228 can be a beveled tip which, in some embodiments, can have a rectangular cross-section. In some embodiments, the tip of the second portion 228 can have a length $t_7$, for example, of about 1 mm or about 0.3 mm, and a width $t_8$, for example, of about 1 mm or about 0.3 mm. The beveled tips of the electrodes 210 and the set of guard combs 220, as well as the wedged side wall of the guard combs 220 can assist in easy slipping of the hair between the inter teeth spacing $d_2$ of the set of guard combs 220 and the set of electrodes 210.

While shown as being disposed parallel to each other flanking the electrodes 210, in some embodiments, set of guard combs 220 can be disposed in a single row along with the set of electrodes 210, for example, located on either side of a pair of electrodes 210 included in the set of electrodes 210 (e.g., a cathode and an anode pair).

Figure 8A:
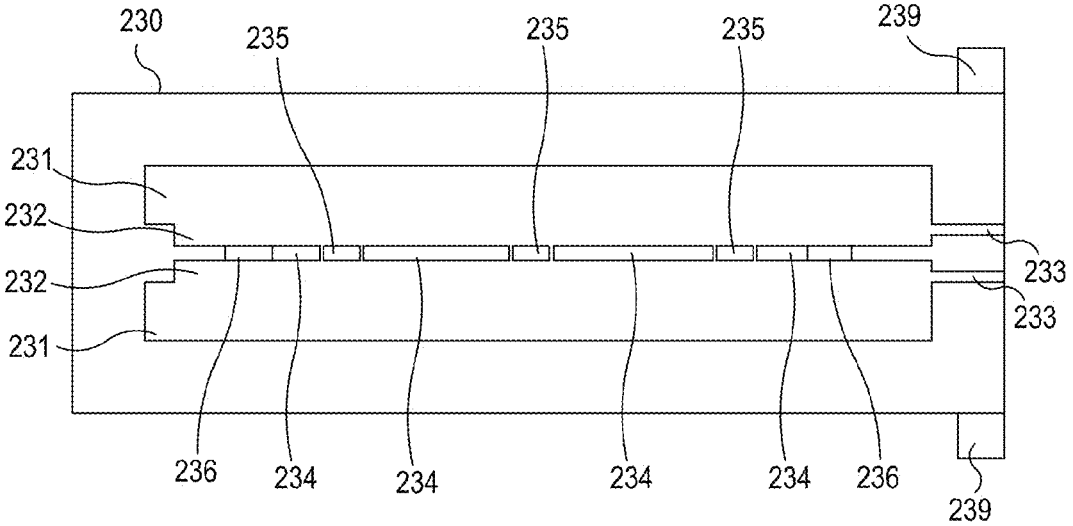

Referring now to FIG. 8A, the frame 230 is configured to include a first cavity 231 sized and shaped to receive at least a portion of the base 222 of the set of guard combs 220 with close tolerance. The frame 230 also includes a second cavity 232 sized and shaped to receive at least a portion of the first portion 212 of at least one of the set of electrodes 210. Thus the set of electrodes 210 and the set of guard combs 220 can be removably disposed in the frame 230 using a simple friction fit mechanism, such that any one of the electrodes 210 and the guard combs 220 can be replaced as needed. In some embodiments, each of the first cavity 231 and the second cavity 232 can also include grooves, notches, detents, latch, spring latch, latch release mechanism, or any other suitable coupling mechanism for removably receiving the set of electrodes 210 and/or the set of guard combs 220.

The frame 230 also includes a pair of slots 233, sized and shaped to receive at least a portion of the second portion 214 of the first set of electrodes 210*a* and the second set of electrodes 210*b*, respectively with close tolerance. The second portion 214 of the set of electrodes 210 can extend beyond the slots 233 such that the second portion 214 of each of the set of electrodes 210 can be inserted into and electrically coupled to the control module 250. A plurality of ridges 234 are disposed in a central portion of the frame 230 such that, the ridges 234 serve as a separation barrier between the set of electrodes 210. A plurality of fluidic channels 235 are defined in the empty space between each of the ridges 234. The fluidic channels 235 are in fluidic communication with the electrolyte reservoir 240. A set of projections 236 are disposed on the ridges, such that at least a portion of the sidewall of each of the first set of electrodes 210*a* and the second set of electrodes 210*b* that face each other, and at least a portion of the sidewall of each of the projections 236, define an enclosed space for housing the first electrolyte reservoir 229 (as shown in FIG. 3).

Figure 8B:
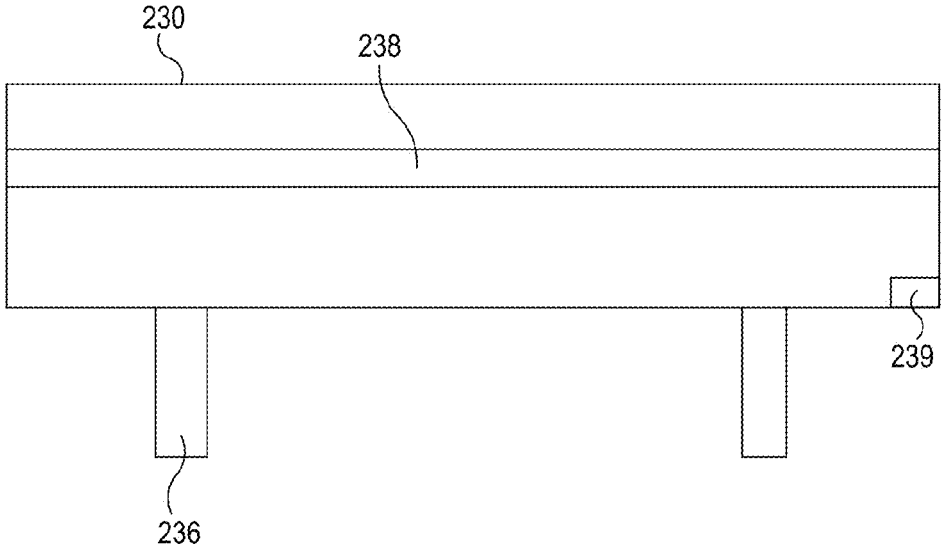
FIG. 8B is a side view of a frame included in the apparatus of FIG. 2.

A groove 238 is defined in at least one of the sidewall of the frame 230 (FIG. 8B). The groove is configured to receive a clamp 244 of the second electrolyte reservoir 240, as described herein. The frame 230 also includes a coupling portion 239, which can include, for example, through holes, threaded apertures, or any other coupling mechanism for removably coupling the frame 230 to the control module 250, for example, using screws. The frame can be made of light weight and insulating material, for example, plastics, polycarbonate, or any other suitable material.

Figure 9A:
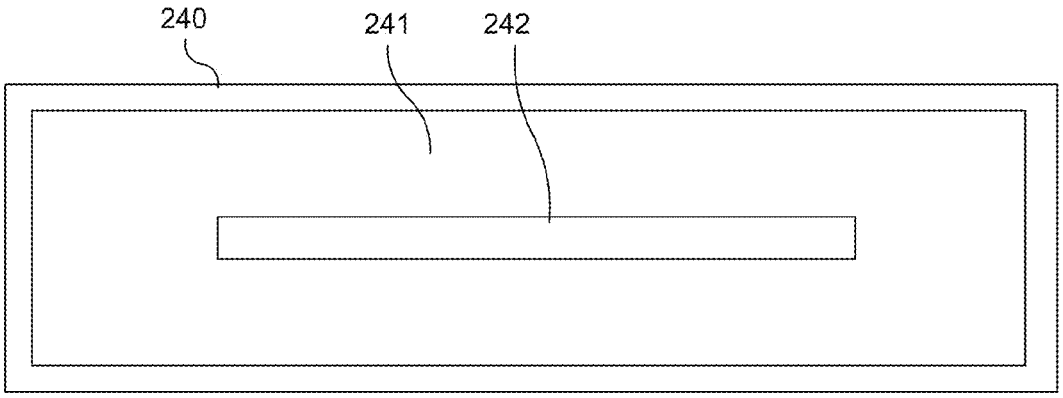
FIG. 9A is a top view.
Figure 9B:
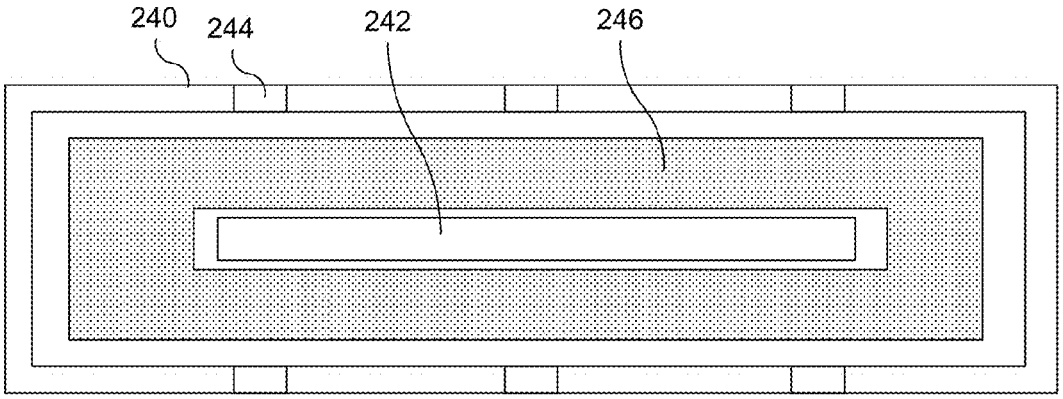
FIG. 9B is a bottom view.
Figure 9C:
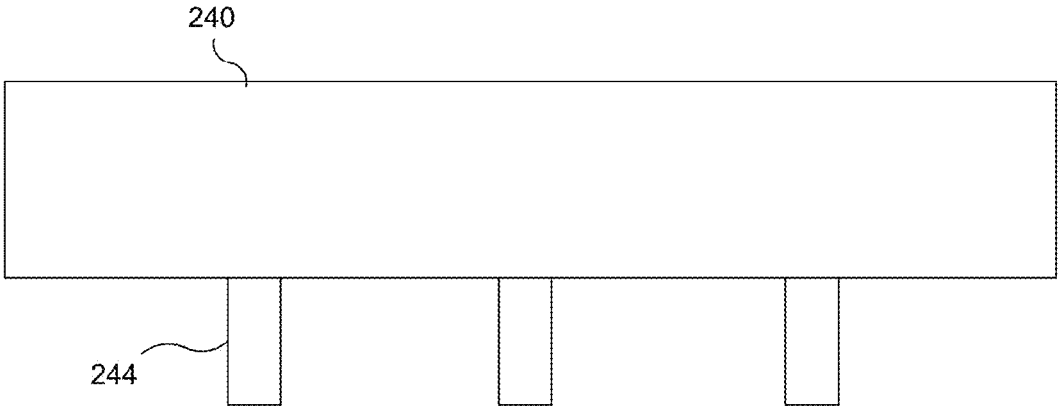
FIG. 9C is a side view of a second electrolyte reservoir included in the apparatus of FIG. 2.

Referring now to FIGS. 9A-C, the second electrolyte reservoir 240 is configured to contain a volume of the electrolyte. The second electrolyte reservoir 240 is configured to be fluidically coupled to the first electrolyte reservoir 229 and to transfer at least a portion of the electrolyte to the first electrolyte reservoir 229. The second electrolyte reservoir 240 defines an internal volume 241 for containing the electrolyte, for example, any of the electrolytes described herein. A fluid channel 242 is defined at the base of the internal volume 241, such that the second electrolyte reservoir 240 is in fluidic communication with the frame 230 and the first electrolyte reservoir 229 via the fluid channels 235 defined in the frame 230. As shown herein, the electrolyte can be communicated from the second electrolyte reservoir 240 to the first electrolyte reservoir 229 in response to gravitational force and/or capillary force. While not shown, in some embodiments, the apparatus 200 can include a supply mechanism to communicate the electrolyte from the second electrolyte reservoir 240 to the first electrolyte reservoir 229. For example, in some embodiments, the apparatus 200 can include a pumping mechanism configured to transfer at least a portion of the electrolyte from the second electrolyte reservoir 240 to the first electrolyte reservoir 229. In some embodiments, the pumping mechanism can include a manual pumping mechanism such as, for example, a hand pump, a hand syringe pump, a bubble pump, a gas pump, etc. In some embodiments, the pumping mechanism can include an electrical pumping mechanism such as, for example, a micropump, a peristaltic pump, an electric syringe pump, or any other electric pumping mechanism. In some embodiments, the pumping mechanism can include an automated pumping mechanism. For example, the pumping mechanism can include sensors (e.g., flow sensors, or liquid level sensors) to determine a volume of the liquid disposed in the first electrolyte reservoir 229 and/or maintained between the first set of electrodes 210*a* and the second set of electrodes 210*b* by the first electrolyte reservoir 229. In some embodiments, an electronic parameter (e.g., a current passing through the electrolyte, or resistance of the electrolyte) can be used to determine a volume of the liquid disposed in the first electrolyte reservoir 229 and/or maintained between the first set of electrodes 210*a* and the second set of electrodes 210*b* by the first electrolyte reservoir 229. In such embodiments, the pumping mechanism can include a feedback mechanism or control mechanism to analyze the sensor data to determine if the volume of the liquid disposed in the first electrolyte reservoir 229 and/or maintained between the first set of electrodes 210*a* and the second set of electrodes 220*b* is within or below a certain threshold. If the volume of the electrolyte is below the predetermined threshold, the automated pumping mechanism can be configured to fluidically communicate at least a portion of the electrolyte from the second electrolyte reservoir 240 to the first electrolyte reservoir 229, and between the set of electrodes 210 therefrom. In this manner, a volume of the electrolyte above a predetermined threshold can be maintained between the set of electrodes 210 in an automated manner.

In some embodiments, the second electrolyte reservoir 240 can be configured to be removably coupled to the apparatus 100 via the frame. In some embodiments, the second electrolyte reservoir 240 can be configured to be refillable via, for example, a port. As shown in FIGS. 9B and 9C, the second electrolyte reservoir 240 includes plurality of clamps 244, configured to engage the groove 238 included in the frame 230, for example, snap-fit into the groove 230, such that the second electrolyte reservoir 240 can be removably coupled to the frame 230. A seal 246 is also disposed on a bottom surface of the second electrolyte reservoir 240. The seal 246 is configured to contact a top surface of the frame 230, such that a fluid tight seal is formed around the fluidic channel 242 and each of the plurality of fluidic channels 235 included in the frame 230. Thus, the seal 246 prevents any electrolyte from leaking through the space between the frame 230 and the second electrolyte reservoir 240. In some embodiments, the seal 246 can also serve as a compliance member to ensure that each of the plurality of clamps 244 engages the grooves 238 with substantially no slip. The seal 246 can be made from any suitable inert material, for example, rubber, silicone, any other suitable material or combination thereof. In some embodiments, the seal can be about 1 mm thick. In some embodiments, the seal 246 can be permanently disposed on the bottom surface of the second electrolyte reservoir 240 using a suitable adhesive, for example, and acrylic adhesive.

Figure 10:
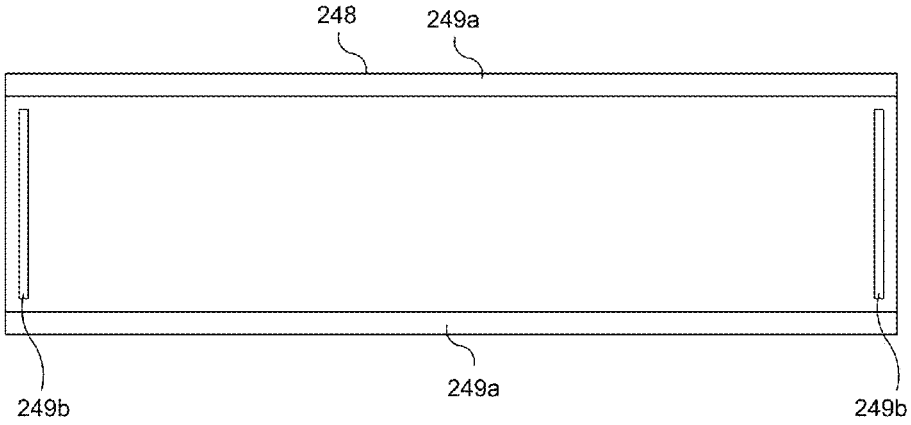
FIG. 10 is a bottom view of a lid of the second electrolyte reservoir of FIG. 9.

Referring also now to FIG. 10, the second electrolyte reservoir 240 also includes a lid 248. The lid 248 includes a pair of first ridges 249*a*, and a pair of second ridges 249*b* (collectively referred to as the "ridges 249"). Each of the ridges 249 can be sized and shaped to slide over a sidewall of the second electrolyte reservoir 240 with tight tolerance, such that the lid 248 forms a fluid tight seal with the electrolyte reservoir. Thus, the lid 240 can be removably coupled to the second electrolyte reservoir 240 using a friction fit mechanism. In some embodiments, each of the ridges 249 of the lid and the sidewalls of the second electrolyte reservoir 240 can include corresponding grooves, notches, detents, indents, hinges, latch, or any other suitable coupling mechanism. Each of the second electrolyte reservoir 240 and the lid 248 can be made from light weight, and inert materials, for example, plastics, polycarbonate, any other suitable material or combination thereof.

Figure 11:
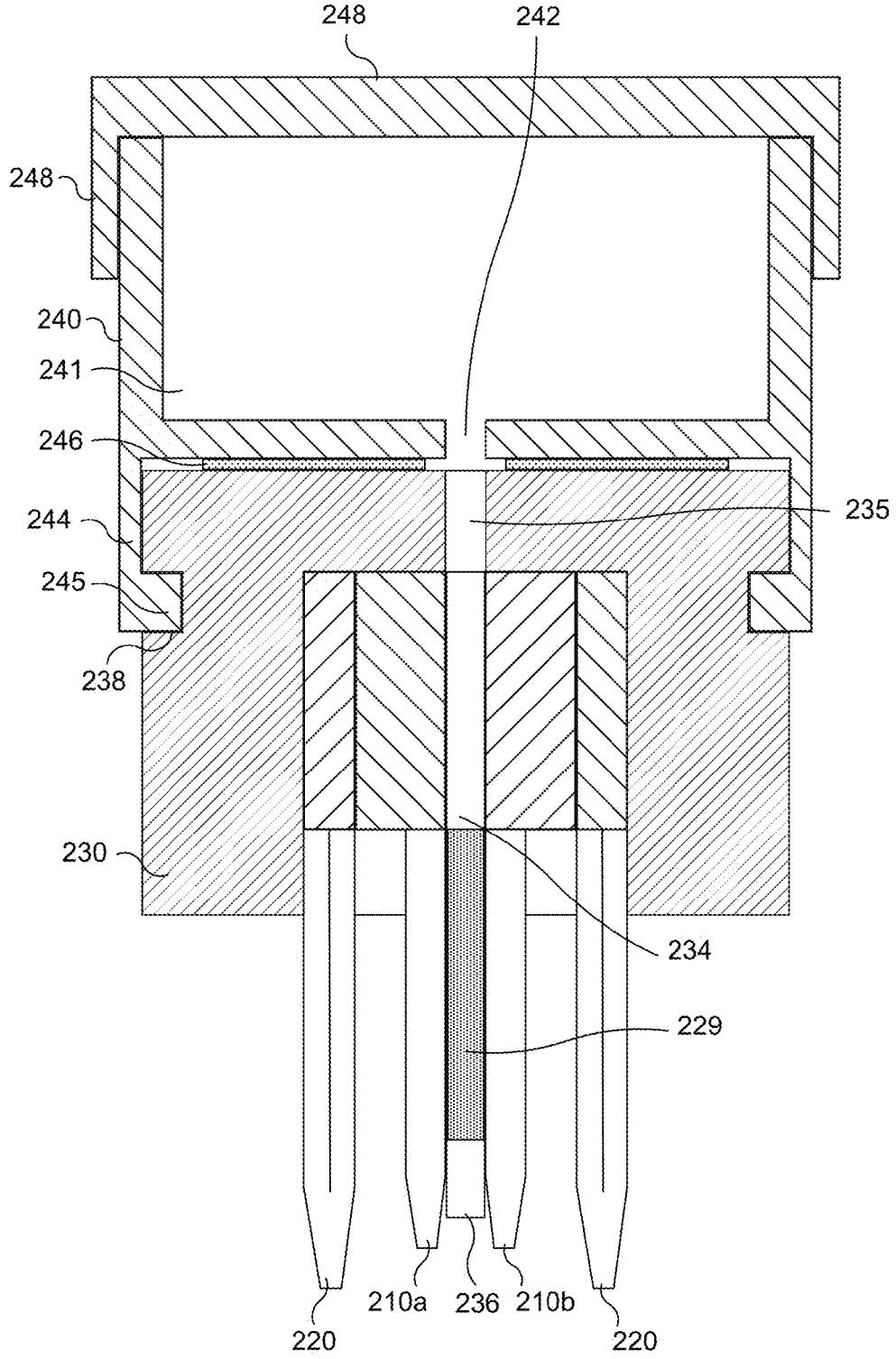
FIG. 11 is a front cross section view of the apparatus of FIG. 2.
Figure 12:
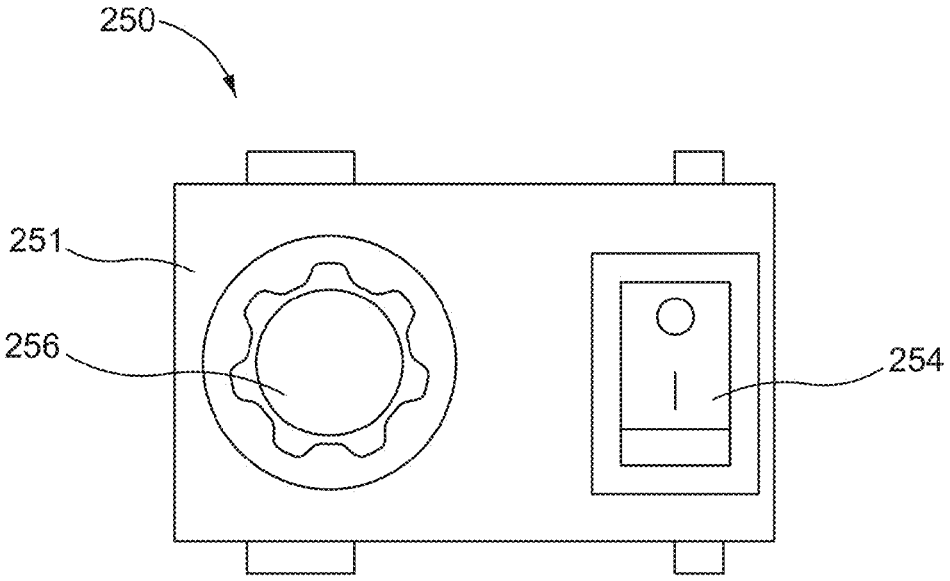
FIG. 12 is a top view of a control module included in the apparatus of FIG. 2.

FIG. 11 shows a front cross section of the apparatus 200 showing the second electrolyte reservoir 240 disposed on and coupled to the frame 230. In the coupled configuration, a ledge 245 included in each of the clamps 244 is disposed in the groove 238 defined on the sidewalls of the frame 230. The internal volume 241 defined by the second electrolyte reservoir 240 is sealed on the top by the lid 248. The electrolyte disposed in the internal volume 241 of the second electrolyte reservoir 240 is also in fluidic communication with the first electrolyte reservoir 239, disposed between the space defined by the sidewalls of the first sets of electrodes 210*a*, the second set of electrodes 210*b* and the set of protrusions 236, through at least one of the fluidic channels 235. The seal 246 forms a fluid tight seal which prevents the electrolyte from leaking between the second electrolyte reservoir 240 and the frame 230. Gravitational and/or capillary forces urge the electrolyte to drain from the second electrolyte reservoir 240 to the first electrolyte reservoir 229. When a user slides the comb through hair, the first electrolyte reservoir 229 can compress releasing a volume of electrolyte in the space between the first set of electrodes 210*a* and the second set of electrodes 210*b*. The electric flow between the set of electrodes 210 can generate a force to drain the electrolyte from second electrolyte reservoir 240. Furthermore, a small amount of gas bubbles generated during electrolysis can ascend into the second electrolyte reservoir 240 and push the electrolyte down. The leaking of the electrolyte down the sides from the space between the set of electrodes 210 can be prevented by surface tension which also prevents the electrolyte form breaking out into drops. When the electric current flows through the electrolyte it also gets highly polarized which further increases the surface tension. As can be seen in FIG. 11, the set of guard combs 220 are longer than the set of electrodes 210, such that the set of electrodes 210 never come in contact with the scalp, thus preventing any damage from the highly acidic and basic zones surrounding the set of electrodes 210 and/or heat produced by the set of electrodes 210.

Figure 14:
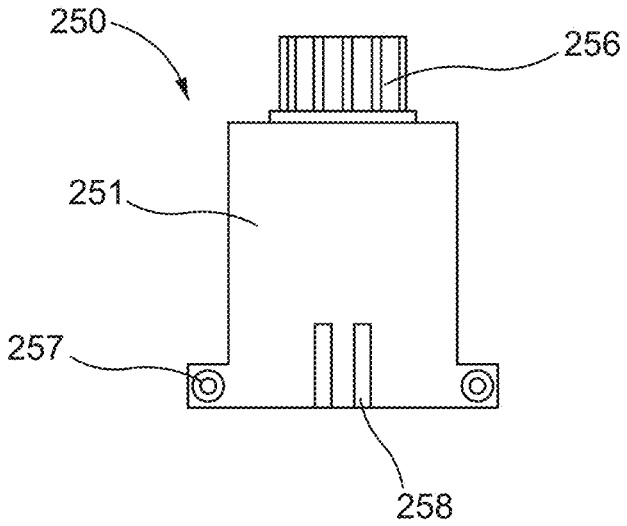
FIG. 14 is a front view of the control module of FIG. 12.
Figure 15:
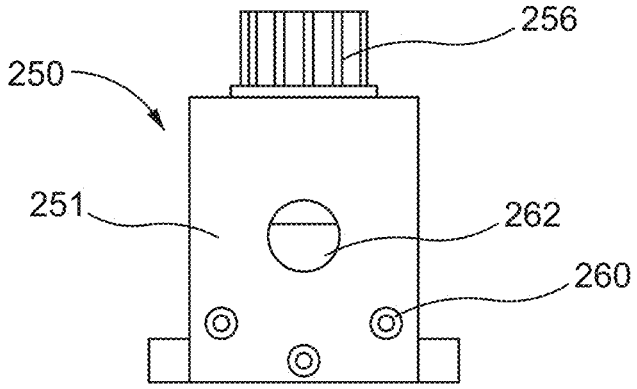
FIG. 15 is a back view of the control module of FIG. 12.
Figure 16:
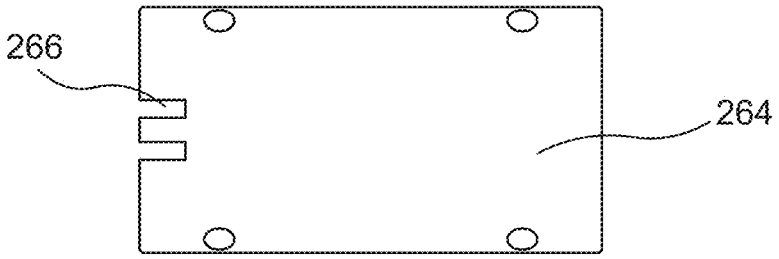
FIG. 16 is a top view of base included in the control module of FIG. 12.
Figure 17:
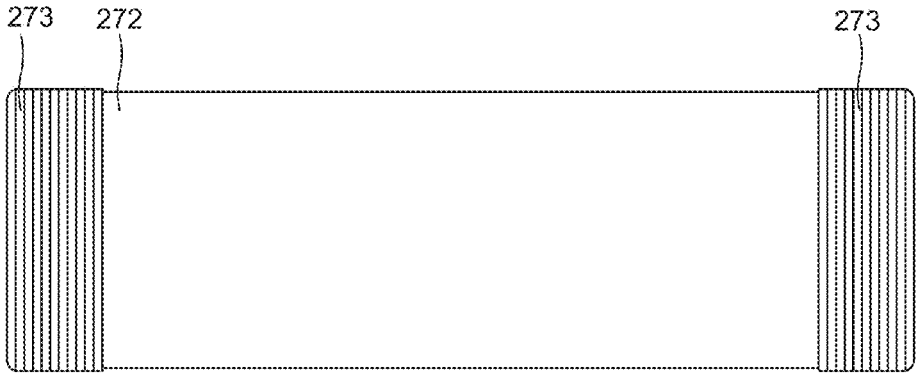
FIG. 17 is a side view of a housing of a power module included in the apparatus of FIG. 2.

Referring now to FIGS. 12-16, the control module 250 is coupled to the first set of electrodes 210*a* and the second set of electrodes 210*b*. The control module 250 is operable to bias the first set of electrodes 210*a* at a first potential and the second set of electrodes 210*b* at a second potential to create an electrical potential difference between the first set of electrodes 210*a* and the second set of electrodes 210*b*. The electrical potential difference is configured to produce an electrolysis zone in the electrolyte disposed between the first set of electrodes 210*a* and the second set of electrodes 210*b*, and to style hair disposed between the first set of electrodes 210*a* and the second set of electrodes 210*b*. The control module 250 includes a housing 251 and a base 264 (FIG. 16). The housing 251 and the base 264 can be removably coupled together, for example, using screws, bolts, using a snap fit mechanism, or any other suitable coupling mechanism. In some embodiments, the housing 251 can be fixedly coupled to the base 264, for example, using rivets or an adhesive. The housing 251 and/or the base 264 can be made from a light weight material, for example, plastics, metals (e.g., aluminum or stainless steel), any other suitable material or combination thereof. The base 264 also defines a pair of slots 266, configured to receive at least a portion of second portion 214 of the set of electrodes 210, when the frame 230 and the set of electrodes 210 are coupled to the control module 250.

Figure 13:
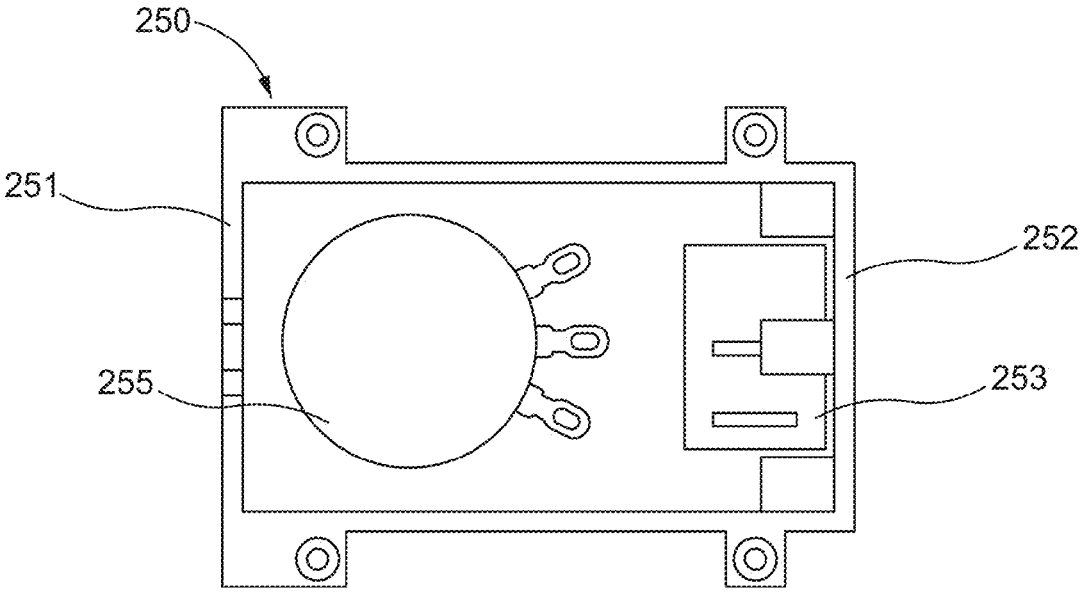
FIG. 13 is a bottom view of the control module of FIG. 12.

The housing 251 defines an enclosed internal volume 252 as shown in the bottom view of the control module 250 in FIG. 13. A DPDT switch 253 and a variable resistor 255, for example, a rheostat or potentiometer are disposed in the internal volume 251, such that a toggle switch 254 of the DPDT switch 253, and a knob 256 of the variable resistor 255 are disposed on a top surface of the housing 251. In some embodiments, the variable resistor 255 can be a 0-2 kΩ resistor. A user can use the toggle switch 254 to define the polarity of the set of electrodes 210, such that each of the first set of electrodes 210*a* and the second set of electrodes 210*b* can be selected to be the anode or the cathode. This can enable the apparatus 200 to be used left handed as well right handed by simply switching the polarity of the electrodes 210. A user can also use the knob 256 to control the amount the resistance of the variable resistance 255, thereby controlling the potential applied across the set of electrodes 210 and the intensity of the electrolysis zone.

FIG. 14 shows a front view of the control module 250. A front surface of the housing 251 of the control module 250 abuts the frame 230. The front surface includes a coupling portion 257 which includes through holes for removably coupling the control module 250 to the coupling portion 237 of the frame 230, for example, using screws. A pair of slots 258 are defined on the front surface and are configured to receive the second portion 214 of each of the set of electrodes 210. The second portion 214 of the set of electrodes 210 can then be coupled to the electronics included in the control module 250, for example, the DPDT switch, using suitable electronic couplings, for example, wires, magnetic couplings, plugs, etc. FIG. 15 shows a back view of the control module 250. A back surface of the housing 251 of the control module 250 abuts the power module 270. The back surface includes a plurality of through holes 260 (e.g., 3 through holes), configured to removably couple the control module 250 to the power module 270, for example, using screws. The back surface also includes a void 262, configured to enable electrical coupling of the control module 250 with the power module 270. For example, wires from the power module 270 can be inserted through the void 262 into the control module 250 to supply electrical power to the control module 250.

Figure 18A:
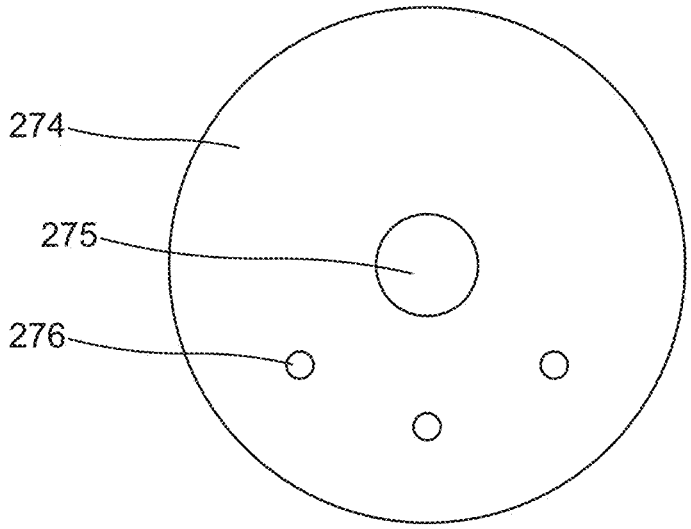
Figure 18B:
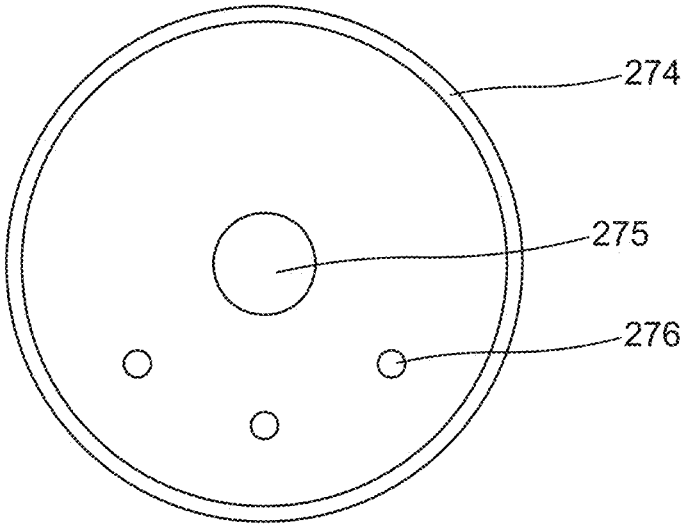
FIG. 18B is a back view of a first end cap of the housing shown in FIG. 17.
Figure 19:
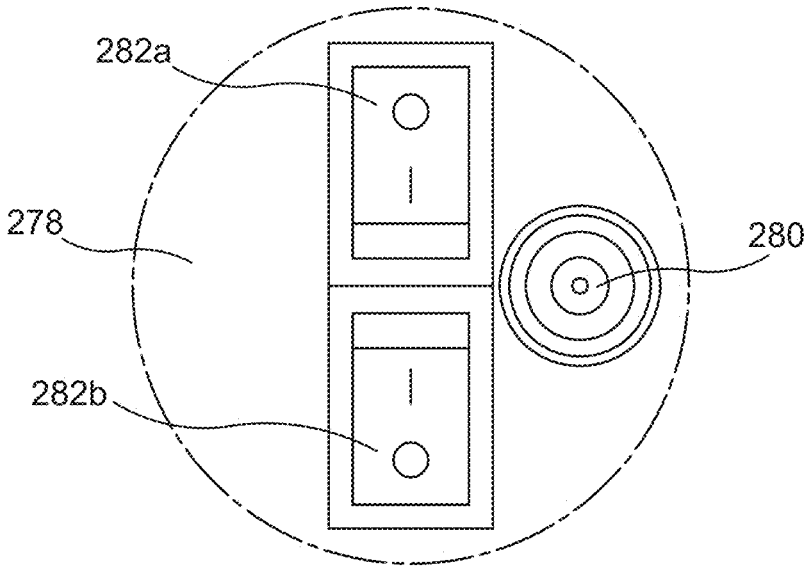
FIG. 19 is a second end cap of the housing shown in FIG. 17.
Figure 20:
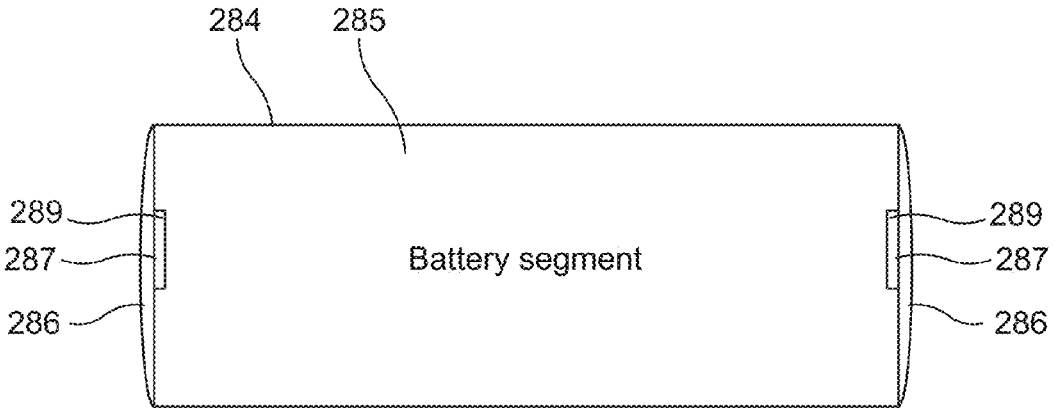
FIG. 20 is a side view of a power source included in the power module of the apparatus of FIG. 2.
Figure 21:
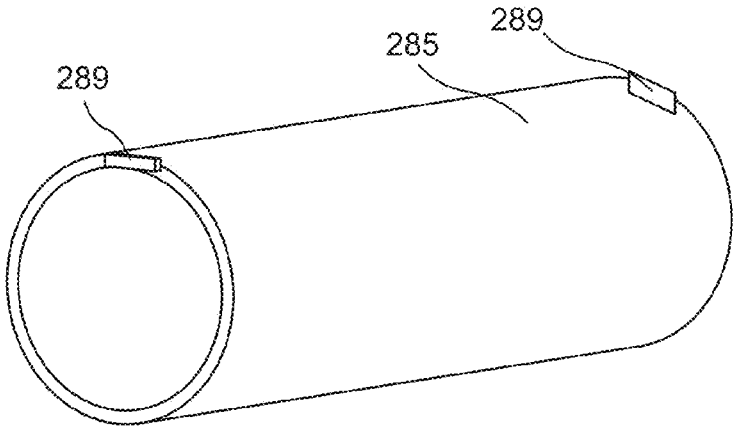
FIG. 21 is a perspective view of a housing of the power source shown in FIG. 20.
Figure 22:
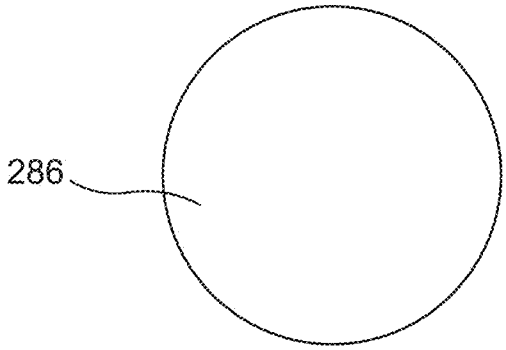
FIG. 22 is an end cap of the housing shown in FIG. 21.
Figure 23:
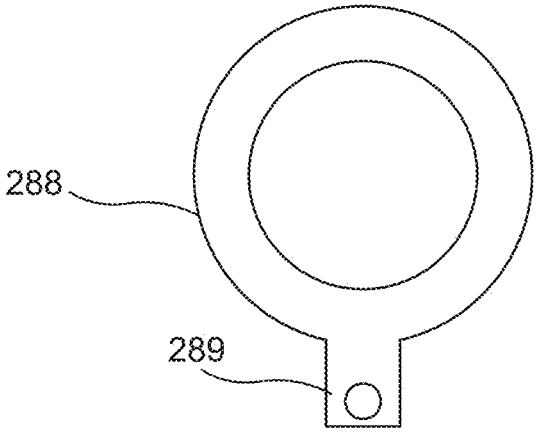
FIG. 23 is a terminal cap of the power source shown in FIG. 20.

Referring now to FIGS. 17-23, the power module 270 includes a housing 272 (FIG. 17) that defines an internal volume for housing the power source 284 (FIG. 20). The housing 272 is in the form of a hollow cylinder and includes threads 273 at each end for removably coupling a first end cap 274 and a second end cap 278 on either end of the housing 272. The housing 272 can be made from a light weight material, for example, aluminum, stainless steel, or plastics. The housing 272 can be monolithically formed, or composed of two halves that can be coupled together, for example, using a snap fit mechanism, screwed, bolted, riveted, heat welded, fusion bonded, or joined with an adhesive. In some embodiments, the two halves of the housing 272 can be held together by the first end cap 274 and the second end cap 278.

The first end cap 274 (FIG. 18A) can be coupled to the housing 272 by screwing the first end cap 274 on the threads 273 of the housing 272 located proximal to the control module 250. Thereon, the first end cap 274 abuts the back surface of the control module 250. The first end cap 274 includes a void 275, configured to allow electrical coupling of the power module 270 with the control module 250 via the void 262 located on the back surface of the control module 250. The first end cap 274 also includes a plurality of through holes 276 for coupling the first end cap 274 and thereby, the power module 270 to the control module 250, for example, via screws. Thus the void 275 and the holes 276 of the first end cap 274 can be located such that when the first end cap 274 abuts the back surface of the housing 251 of the control modules, the void 275 is adjacent and in line with the void 262 of the control module 250, the holes 276 line up with the holes 260 of the control module 250. In some embodiments, the first end cap 274 can be made from the same material as the housing 272. As shown in FIG. 18B, an internal surface of the first end cap 274 can be reinforced by a metal plate, for example, a steel plate.

As shown in FIG. 19, the second end cap 278 can also be coupled to the housing 272 using threads 273 located on the end of the housing 272 distal to the control module 250. The second end cap 278 includes a charging port 280, for example, a DC female plug, configured to receive a charging lead from an external power source, for example, a docking unit 290 as described herein. The second end cap 278 can also include a first switch 282*a* and a second 282*b* that can be toggled in a predetermined combination to define a charging state of the apparatus 200, as described herein.

Referring now to FIG. 20-23, a power source 284 included in the power module 270 includes a housing 285 that includes a hollow cylinder 285 having a notch 287 located at each end of the housing 285. A plurality of rechargeable cells can be disposed in the housing 285 and the open ends of the housing 285 can be closed with flat end caps 286. In some embodiments, the rechargeable cells can include a plurality of lithium-ion coin cells which can be stacked in series to provide the desired potential and current. Each end of the cell stack can be coupled to a terminal cap 288, that includes a tab 289 which can protrude through the notch 287 included in the housing 285. Each of the tabs 289 can serve as contacts for electrical coupling of the power source 284 with the control module 250. In some embodiments, the lithium-ion coin cells can include 3.6 volt and 120 mA coin cells. In some embodiments, 12 such cells can be stacked in series in a power source 284, and two power sources 284 connected in parallel can be included in the power module 270, such that the power module 270 provides a potential of about 45 volts and a current of about 240 mA. In some embodiments, any other power source, for example, a plurality of 9 volt and 260 mA batteries can be connected in series and used as the power source. One or more power sources 284 can be disposed inside the housing 272 and secured in place using a packing material, for example, foam, wool, cardboard, or any other suitable packing material and/or inserts.

Figure 24:
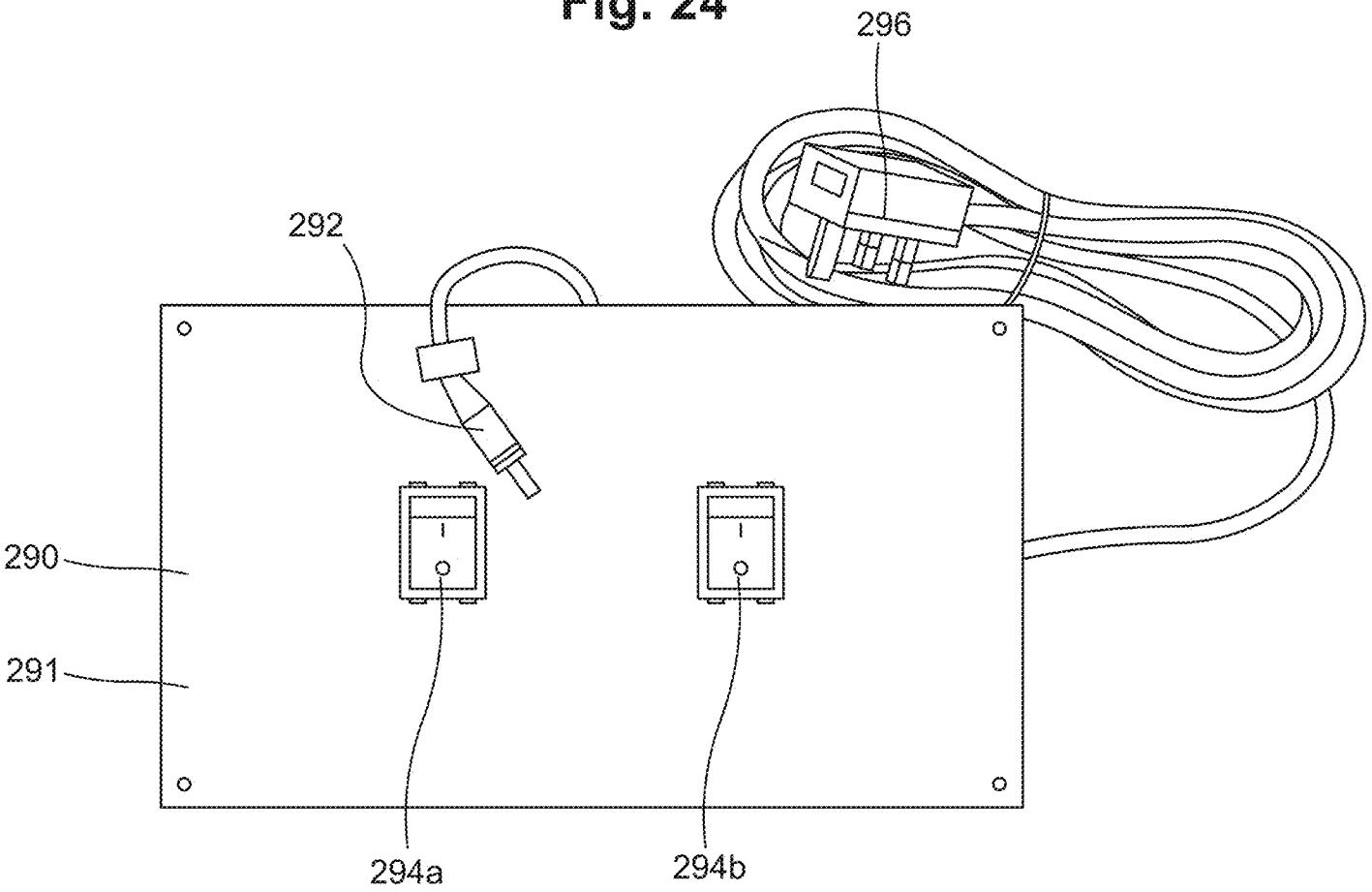
FIG. 24 is a docking unit for providing power to the apparatus of FIG. 2 or charging a power source included in the apparatus of FIG. 2, according to an embodiment.

FIG. 24 shows a docking unit 290 according to an embodiment, which can be used to provide electrical power to the power module 270 to charge the power source 284. The docking unit 290 can include a housing 291 which defines an internal volume for containing a power source, for example, a 48 volt 2 amp DC power source. In some embodiments, the power source can be configured to deliver an electrical output of about 45 volt and about 260 mA. In some embodiments, the power source can be a 24 volt 5 amp power source. In some embodiments, the power source can be a 24 volt 4 amp power source. In some embodiments, the power source can be a 24 volt 3 amp power source. In some embodiments, the power source can be a 12 volt 5 amp power source. In some embodiments, the power source can be a 12 volt 4 amp power source. In some embodiments, the power source can be a 12 volt 3 amp power source.

The docking unit 290 includes a first switch 294*a* and a second switch 294*b*. The first switch 294*a* can, for example, be toggled to allow AC power from an external power outlet (e.g., wall socket) into the docking unit 290, and the second switch 294*b* can, for example, can be toggled to allow the DC power from the docking unit 290 via a DC charging plug 292 into the charging port 280 of the hair styling device 200.

Figure 25:
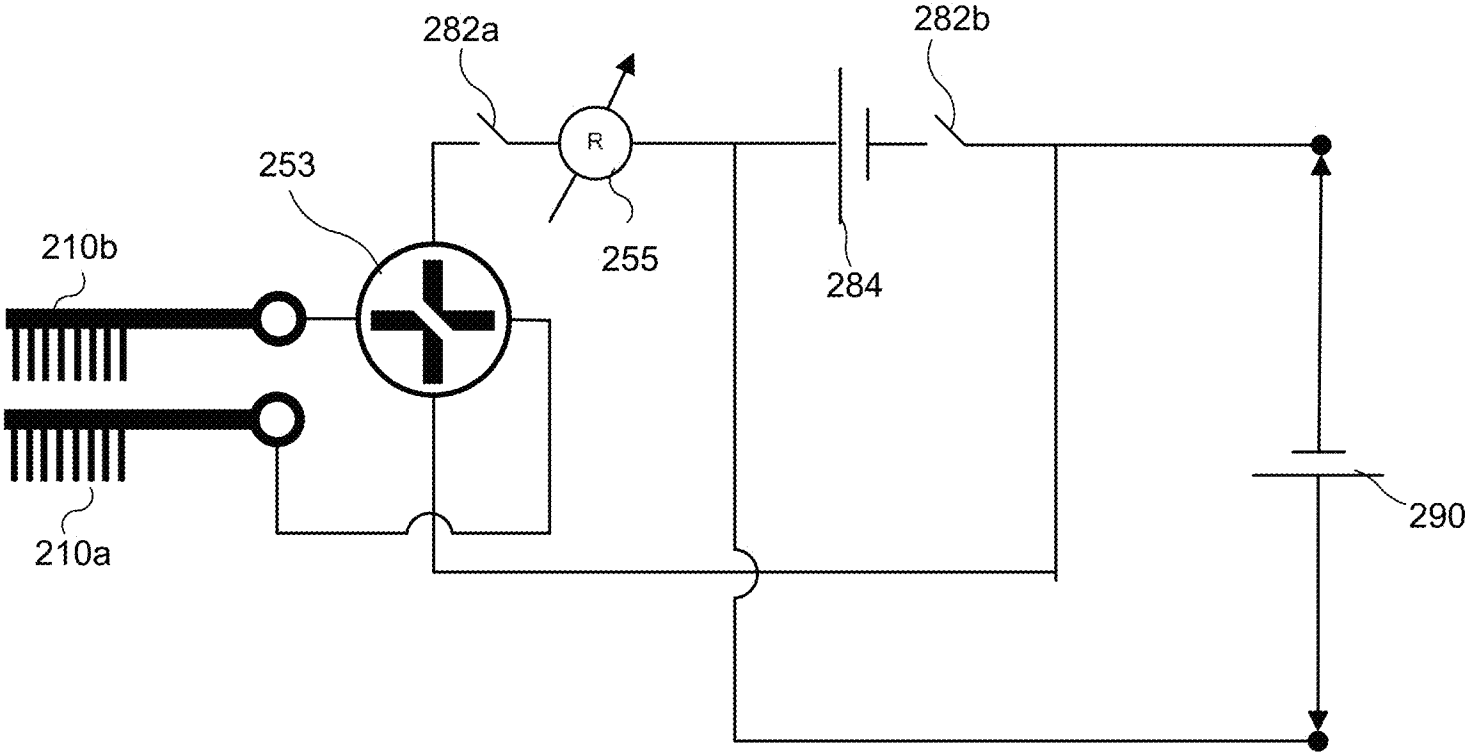
FIG. 25 is a circuit diagram for controlling the charging and operational state of the apparatus of FIG. 2, according to an embodiment.

FIG. 25 shows a circuit diagram that can be used to control the charging and operational state of the hair styling device 200. The electrical circuit between the first set of electrodes 210*a* and the second set of electrodes 210*b* is completed through the electrolyte (not shown), where electrolysis creates a reducing zone proximate to the negatively charged first set of electrodes 210*a* (i.e., cathode) and an oxidizing zone proximate the positively charged second set of electrodes 210*b* (i.e., anode). The DPDT switch 253 can be toggled to reverse the polarity such that now the first set of electrodes 210*a* are the positively charged electrode, and the second set of electrodes 210*b* are the negatively charged electrode. The variable resistor 255 can be used to control the potential difference across the set of electrodes 210. Electrical power can be provided to the set of electrodes 210 either through the power source 284, or directly from an external power source through the docking unit 290. Each of the switches 282*a* and the 282*b* can be toggled in combination to determine a charging and/or power state of the apparatus 200. For example, in a first configuration when the internal power source 284 is used to supply power, the first switch 282*a* and the second switch 282*b* can both be in the on position. In a second configuration when power is drawn directly from the docking unit 290, the first switch 282*a* can be in the on position and the second switch 282*b* can be in the off position. In this configuration, the power source 284 is disconnected from the circuit. In a third configuration, when only the power source 284 is being charged, the first switch 282*a* can be in the off position and the second switch 282*b* can be in the on position. In this configuration, the set of electrodes 210 are disconnected from the circuit.

Figure 26A:
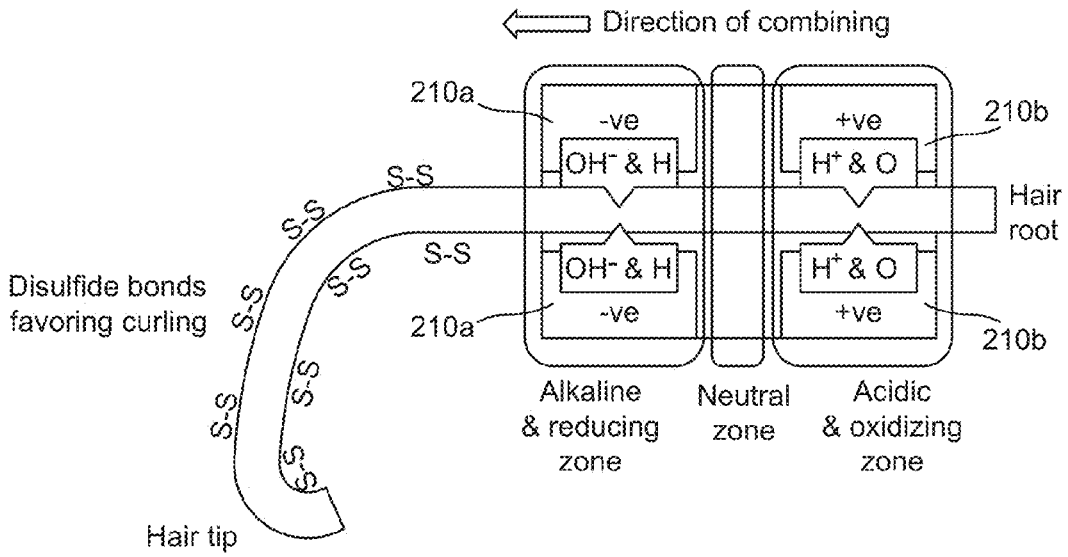
FIG. 26A is a strand of unstraightened hair passing through an alkaline zone of a first negatively charged electrode and an acidic zone of a second positively charged electrode included in the apparatus of FIG. 2.
Figure 26B:
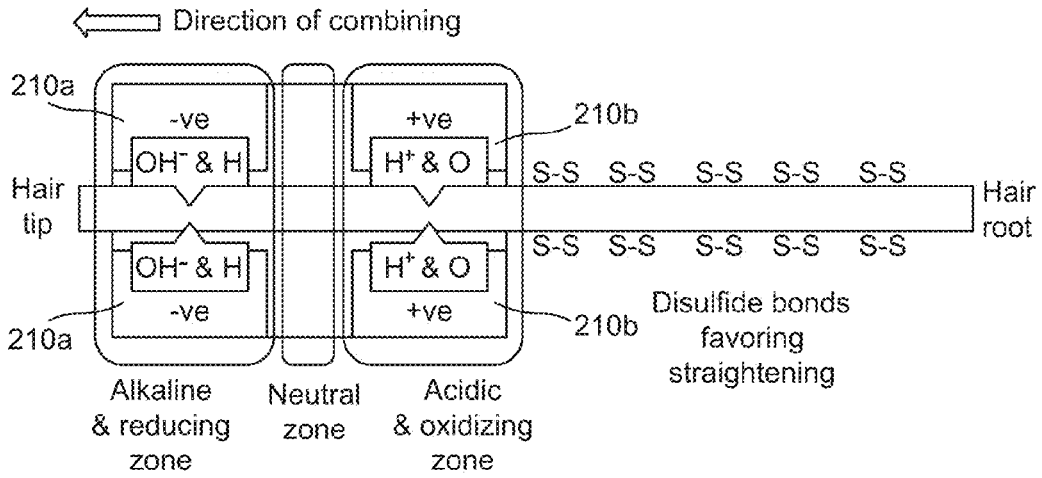
FIG. 26B is the strand of hair straightened after passing through the electrodes.

In some embodiments, the apparatus 200 can be used to straighten the hair of a user. Referring now to FIGS. 26A-B, a user can use the hair styling device 200 as a comb to straighten hair, such that the negatively charged electrode, for example, the first set of electrodes 210*a* is a leading electrode and the positively charged electrode, for example the second electrode 210*b* is a trailing electrode (also referred to herein as "following") electrode. An electrolyte, for example, an aqueous salt solution of sodium chloride or any other suitable electrolyte surrounds the first set of electrodes 210*a* and the second set of electrodes 210*b*. In some embodiments, the electrolyte is in a column. A strand of wavy or curly hair that has a plurality of disulfide bonds disposed on its surface is captured between the teeth of the first set of electrodes 210*a* and the second set of electrodes 210*b*. As the user slides the set of electrodes 210 through the hair, the strand of hair first encounters the alkaline and reducing environment of the first set of electrodes 210*a*. This breaks the disulfide bonds, ionic bonds and hydrogen bonds of the hair and can cause the strand of hair to swell. As the user continues sliding the apparatus 200, the strand of hair now encounters the acidic and oxidizing zone of the second set of electrodes 210*b*. The disulfide bonds, ionic bonds and hydrogen bonds reform on the surface of the strand of hair in an ordered manner, for example parallel to each other, and the hair can also contract. In this manner, the user can straighten hair. It is to be noted that there is no possibility of spillage of the highly basic (about 12-13) or highly acidic (about 1-2) pH electrolyte on to the skin of the user because once the electrolyte is removed from close proximity to the set of electrodes 210, the pH of the electrolyte becomes neutral.

Figure 27:
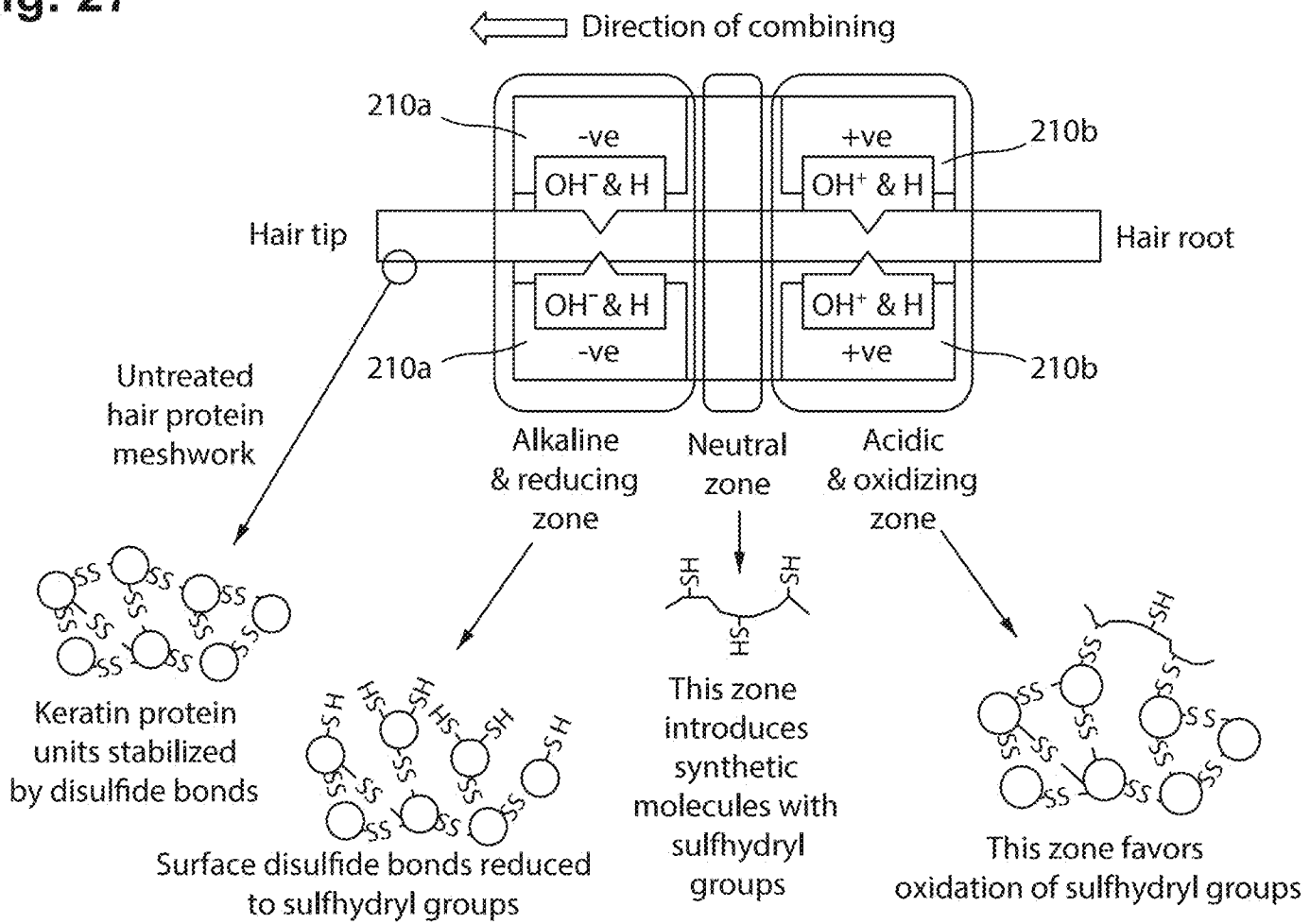
FIG. 27 is a mechanism of incorporating additives into hair using the apparatus of FIG. 2 according to an embodiment.

The apparatus 200 can also be used to perform various hair styling functions other than straightening of the hair, by simply adding additives to the electrolyte, and/or by using a different electrolyte. For example, in some embodiments, the electrolyte can include additives that include a sulfhydryl group, such that the additives can be incorporated into the hair via a disulfide bond by the electrolytic action of the apparatus 200. Referring now to FIG. 27, the hair is composed of a plurality of keratin proteins that are stabilized by a plurality of disulfide bonds. Most of the disulfide bonds are present on the surface of the air. When the hair is exposed to the alkaline and reducing zone of the first set of electrodes 210*a*, at least a portion of the disulfide bonds present on the surface of the hair can be reduced to sulfhydryl groups. The electrolyte also contains additives that can include sulfhydryl group conjugated with the additives (e.g., synthetic molecules). These additives can be introduced in the neutral zone that lies between the negatively charged first set of electrodes 210*a* and the positively charged second set of electrodes 210*b*, and then get incorporated with the surface of the hair via disulfide bonds when the oxidizing zone of the positively charged second set of electrodes 210*b* oxidizes the sulfhydryl groups to disulfide groups.

In this manner, any additive can be incorporated into the hair by including a sulfhydryl group or ionic group or groups favoring hydrogen bonds on the hair in an additive. For example, in some embodiments, the electrolyte can include nanoparticles (e.g., polyethylene glycol, polyvinyl alcohol polymer, metallic nanoparticles, fluorescent nanoparticles, dye loaded nanoparticles, etc.). In some embodiments, the electrolyte can include dyes, for example, polymer (e.g., polyethylene glycol, polyvinyl alcohol polymer) conjugated with colored pigments, for coloring hair. This can be much safer than conventional methods which use active chemicals for dying hair.

In some embodiments, the electrolyte can include one or more additives for moisturizing hair. For example, the additives can include polymers (e.g., polyethylene glycol or polyvinyl alcohol) or nanoparticles which include multiple hydroxyl groups, such that polymers can get incorporated into the hair to moisturize the hair. The conventional methods of moisturizing hair simply add moisturizers to the surface which can be removed on washing. As described herein, the moisturizers are covalently linked to the surface of the hair and therefore the moisturizing effect lasts longer than conventional methods.

In some embodiments, the electrolyte can include one or more additives for thickening of the hair. For example, the additives can be polymers (e.g., polyethylene glycol or polyvinyl alcohol polymer) or nanoparticles which include a plurality of surface functional groups. Once the polymers are incorporated in the hair as described herein, micro-particles that include complimentary functional groups (e.g., oppositely charged groups) on their surface can be added to the treated hair. The complimentary functional groups of the micro-particles will couple to the functional groups of the polymers incorporated in the hair, such that the micro-particles are incorporated into the hair, rapidly adding thickness to the hair. Furthermore, dyes or pigments can also be added to the particles to simultaneously achieve thickening and coloring of the hair. Such micro-particles can be stripped on demand, for example, using a stripping solution that includes a high concentration of oppositely charged ions.

In some embodiments, the electrolyte can include one or more additives for fizz control of the hair. For example, the additive can include polymers or nanoparticles as described herein that include oil molecules that are incorporated into the hair as described herein. This can produce a long lasting non-sticky oil layer on the hair surface which is resistant to drying thereby, preventing fizz, or by adding a molecule with carboxylic groups which repel the hair by means of creating an identical charge on the entire hair surface. Furthermore, the covalently incorporated oil layer can resist stripping by washing with soap, thereby providing long lasting frizz control.

In some embodiments, the electrolyte can include one or more additives for altering the glossiness of the hair. For example, the additive can include polymers or nanoparticles as described herein, which include a fatty acid incorporated with the polymer. The polymer can be incorporated into the hair with the hydrophilic side of the fatty acid on the surface of the hair. The glossiness is produced by reflection of light from the hydrophilic molecule coated surface of the hair.

In some embodiments, the electrolyte can include one or more additives for deodorizing the hair. For example, the additive can include polymers or nanoparticles as described herein, which include multiple COOH groups. When the COOH groups are incorporated into the hair, they produce an acidic environment around the hair which prohibits bacterial growth. Moreover the COOH groups can also donate their $H^+$ ions to the volatile amines and keep them coupled to the surface prohibiting diffusion of odor producing molecules.

In some embodiments, the electrolyte can include one or more additives for augmenting the moldability of the hair. For example, the additive can include polymers or nanoparticles as described herein, which include a long saturated fatty acid (e.g., saturated castor oil). The hydrophobic long saturated fatty acid molecules can stick together by hydrophobic interactions and make it easier to adhere hair fibers together to produce various shaped hair bundles, for example, spiky styling of hair.

In some embodiments, the electrolyte can include a fragrance. The electrolysis process opens up and closes the hair protein matrix by breaking the disulfide bonds. Hence a fragrance molecule included in the electrolyte can diffuse deep into the hair protein matrix and thereby provide long lasting fragrance diffusing out from the hair.

In some embodiments, the apparatus 200 can be used for bleaching of the hair. If an oxidizing molecule, for example, hydrogen peroxide, sodium percarbonate, sodium perborate, or any other oxidizing molecule is included in the electrolyte, the electrolysis process can be shifted towards a more oxidizing process which can be exploited for bleaching of the hair. In addition, if the salt included in the electrolyte is sodium chloride, or any other chlorine based salt, the electrolysis process induces synthesis of chlorine at the anode. Therefore, by adjusting the amount of salt in the electrolyte, the quantity of chlorine generated at the anode can be controlled and can be used for bleaching the hair. In some embodiments, the electrolysis process can also be used for bleaching of the colors added previously to the surface of the hair.

In some embodiments, the apparatus 200 can be used for highlighting hair. In such embodiments, only a portion of the teeth 216 of the set of electrodes 210 are polarized, for example, half the teeth 216, every second pair of teeth 216, or any other combination. Electrolysis will only occur at the teeth 216 that are polarized, therefore only the strands of the hair passing through the polarized electrodes will be styled, for example colored or bleached.

The apparatus 200 can be provided to a user with a plurality of second electrolyte reservoirs 240 such that each second electrolyte reservoir 240 contains a specific electrolyte formulation suitable for performing a specific hair styling function as described herein. Thus a user can uncouple one electrolyte reservoir 240 containing a first electrolyte, for example, for straightening of hair, from the frame 230, and couple another second electrolyte reservoir 240, containing a second electrolyte, for example, for coloring hair. In this manner, the hair styling device 200 can be used to perform various hair styling functions.

Figure 28:
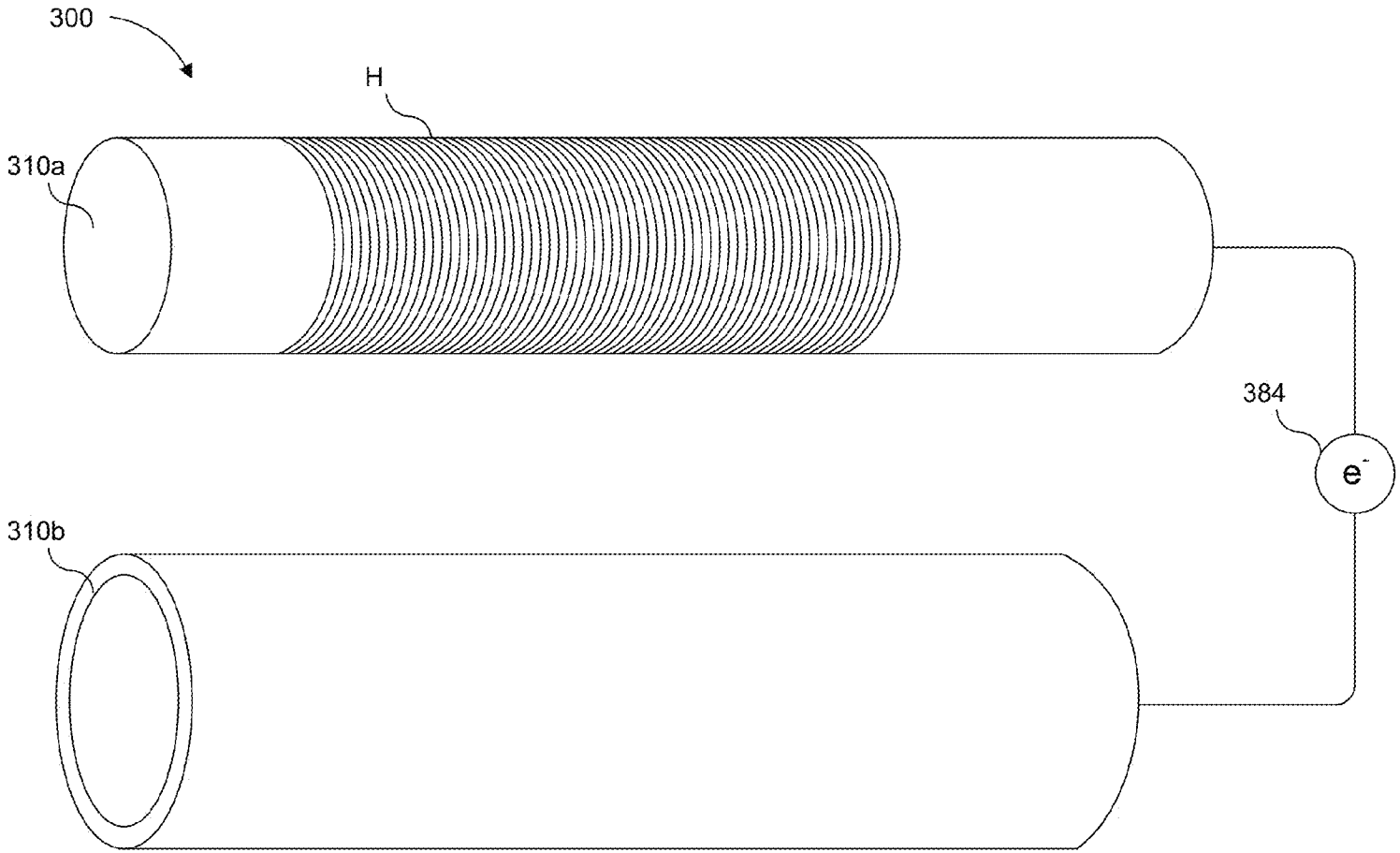
FIG. 28 is a first configuration of a hair styling device for curling hair, according to an embodiment.

In some embodiments, a hair styling device can include electrodes configured to curl hair using electrolysis. Referring now to FIG. 27-28, a hair styling device 300 includes a first electrode 310*a* and a second electrode 310*b*. A power source 384 can be electrically coupled to each of the first electrode 310*a* and the second electrode 310*b* and configured to polarize the electrodes, for example, apply a positive charge on the first electrode 310*a* (i.e., the anode) and a negative charge on the second electrode 310*b* (i.e., the cathode) or vice versa. In some embodiments, a first polarity can be applied to the first electrode 310*a* and the second electrode 310*b* for a predetermined period of time, the polarity can then be reversed for a predetermined period of time. In some embodiments, the polarity reversing cycle can be repeated for a predetermined number of times. The hair styling device 300 can further include a control module (not shown) for controlling the polarizing potential and/or an electrolyte reservoir (not shown) for providing the electrolyte for performing electrolysis.

The first electrode 310*a* is cylindrical in shape and is formed from a conductive material, for example, aluminum, copper, stainless steel, alloys, other metals, ceramics, graphite, any other suitable conductive material, or a combination thereof. The first electrode 310*a* has a circular cross section such that a user can wrap a strand of hair H around the first electrode 310*a*. The first electrode 310*a* can be a hollow or a solid cylinder. In some embodiments, the first electrode 310*a* can have a non-circular cross section, for example, square, rectangular, pentagonal, hexagonal, or any other suitable cross-section. In some embodiments, the first electrode 310 can also include small protrusions configured to grip the hair such that the hair can easily be wrapped around the first electrode 310*a*. The second electrode 310*b* is shaped in the form of a hollow cylinder. The second electrode 310*b* has a cross section substantially greater than the cross section of the first electrode 310*a* such that second electrode 310*b* can slide over the first electrode 310*a* with substantial tolerance. The second electrode 310*b* can be made from a conductive material, for example, aluminum, copper, stainless steel, alloys, other metals, ceramics, graphite, any other suitable conductive material, or a combination thereof.

Figure 29:
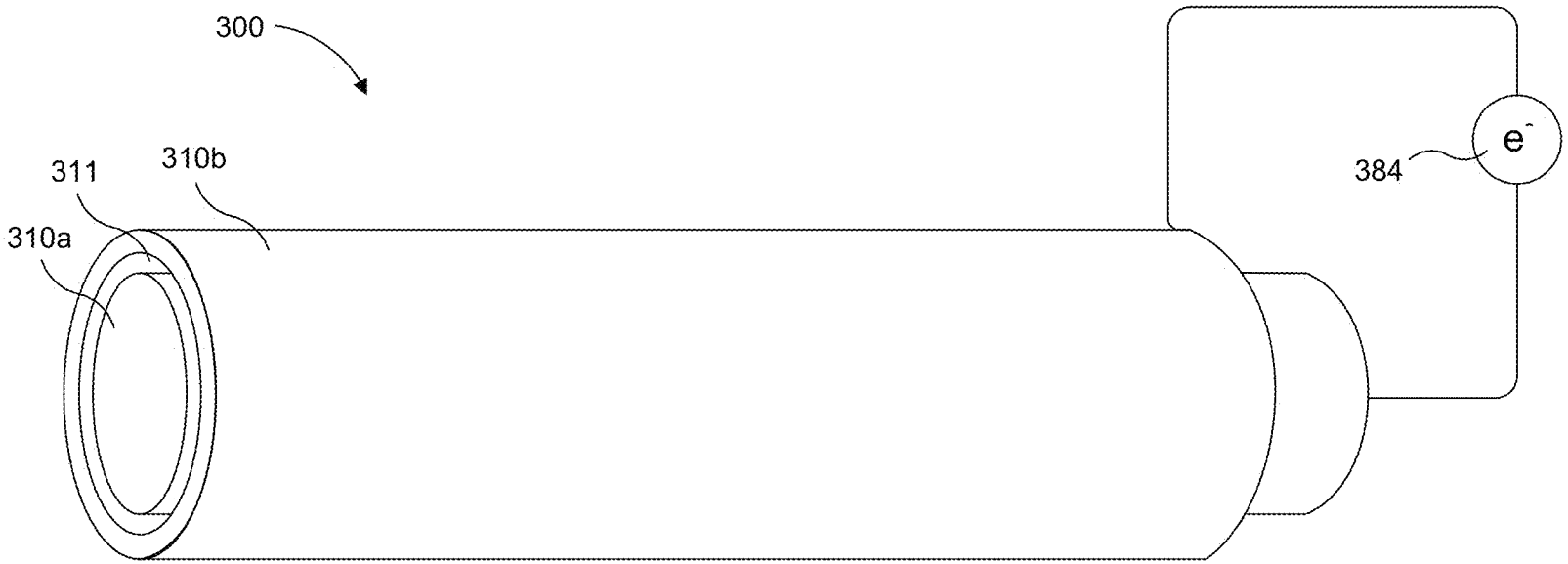
FIG. 29 is the hair styling device of FIG. 28 in a second configuration.

In a first configuration shown in FIG. 28, the first electrode 310*a* and the second electrode 310*b* can be separated from each other. A user can wrap a strand of hair H around the first electrode 310*a*. In the second configuration, as shown in FIG. 29, the user can now slide the second electrode 310*b* over the first electrode 310*a*, such that the second electrode 310*b* is co-axial with the first electrode 310*a* and completely covers the portion of the first electrode 310*a* that has the strand of hair H wrapped around it. In this configuration, a co-axial gap 311 is present between an outer surface of the first electrode 310*a* and an inner surface of the second electrode 310*b*, at least a portion of which is occupied by the strand of hair H. The first electrode 310*a* and the second electrode 310*b* can be immersed in a solution of an electrolyte, for example, any of the electrolytes described herein, such that the electrolyte now bridges the gap 311 between the first electrode 310*a* and the second electrode 310*b* and completes an electric circuit for undergoing electrolysis. In some embodiments, electrolyte can be poured into the gap 311. In some embodiments, the electrolyte can be sprayed on the hair before and/or after wrapping around the first electrode 310*a*. The power source 384 can now be turned on to polarize the electrodes, such that the electrolyte is electrolysed. In this manner, electrolysis can be used to curl the hair H. In some embodiments, additives can be included in the electrolyte to perform additional styling functions on the hair H, for example, coloring, moisturizing, deodorizing, or any other styling function as described herein with respect to the hair styling device 200.

Figure 30B:
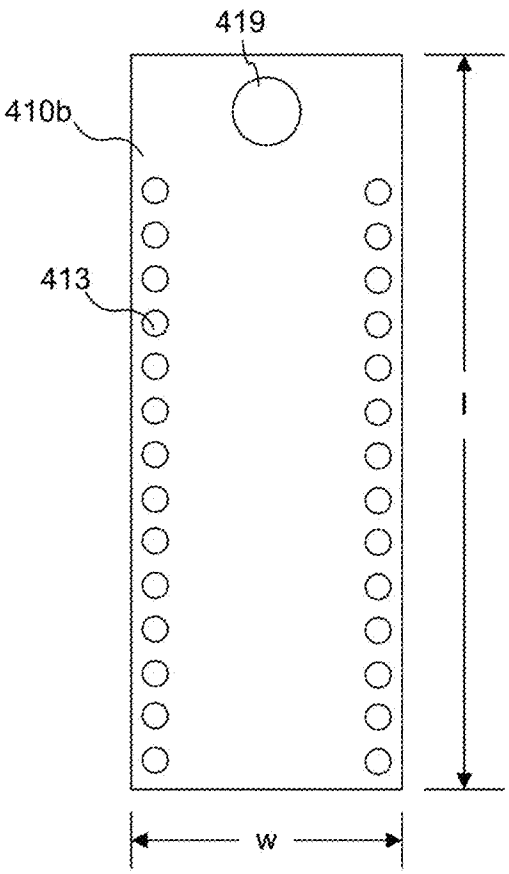
FIG. 30B shows a front view of a second electrode included in a hair styling device for curling hair, according to an embodiment.
Figure 30A:
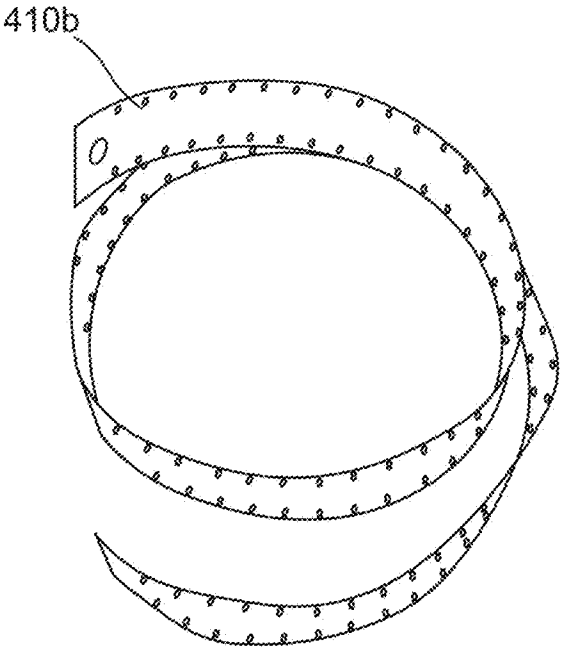

In some embodiments, the second electrode can be configured to be wrapped around the first electrode. Referring now to FIG. 30A-B, a hair styling device, for example, the hair styling device 300 can include a first cylindrical electrode, for example, the first electrode 310*a* and a second electrode 410*b* shaped and sized to resemble a flat ribbon. The second electrode 410*b* can be made from a conductive material, for example, aluminum, stainless steel, alloys, ceramics, graphite, any other suitable material or combination thereof, and can be relatively thin, for example, have a thickness of about 0.40 mm. The second electrode 410*b* can be flexible such that it can be wrapped around a cylindrical first electrode, for example, the electrode 310*a*. The second electrode 410*b* also includes a plurality of perforations 413 along the edges of the electrode to increase the flexibility. An aperture 419 is located at one end of the second electrode 410*b* which can be used to couple the second electrode 410*b* to a power source, for example, the power source 384. A user can wrap her hair around the first electrode, for example, the first electrode 310*a*, and then wrap the second electrode 410*b* around the hair. The hair can be pre coated with the electrolyte, or the electrode pair can be immersed in an electrolyte, for example, any of the electrolytes described herein. Wrapping of the second electrode 410*b* over the hair on the first electrode reduces the thickness of the electrolyte layer and hence the resistance. This can increase the rate of the electrolysis as well as the speed at which the hair is curled.

Figure 31:
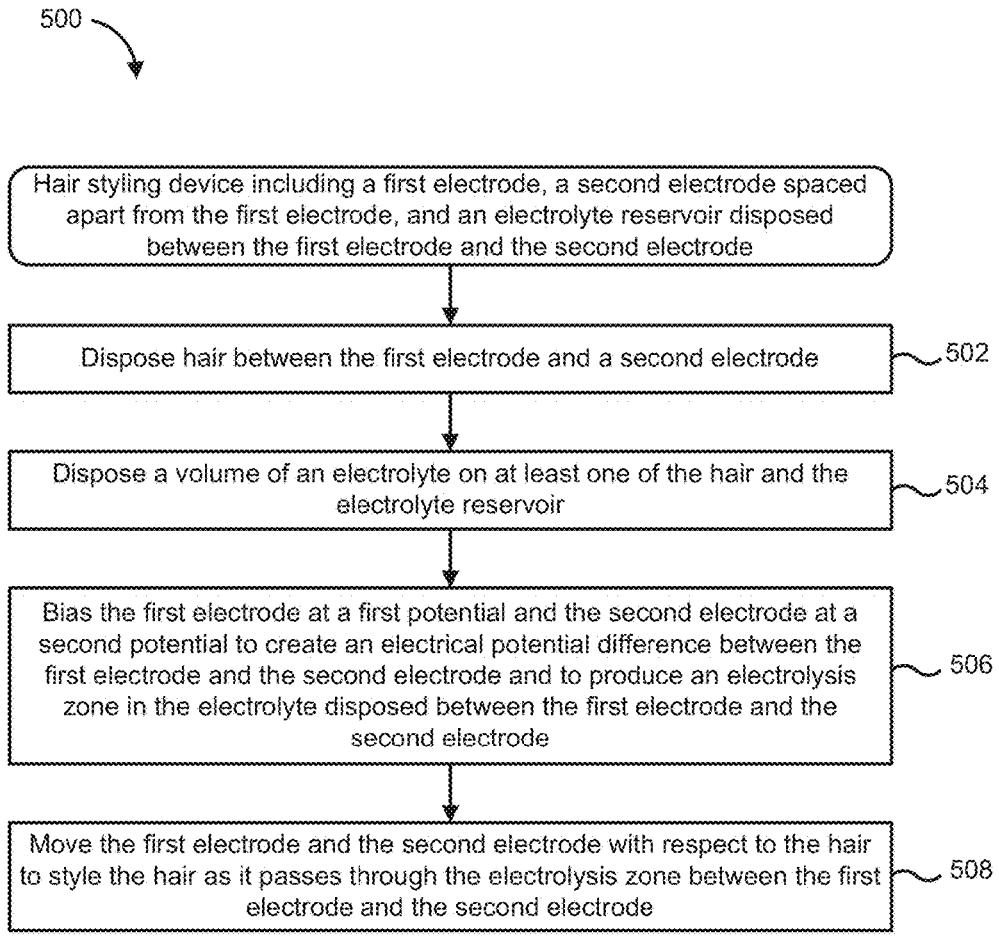
FIG. 31 is a schematic flow diagram of a method for styling hair using a hair styling device which includes a first electrode, a second electrode spaced apart from the first electrode, and an electrolyte reservoir disposed between the first electrode and the second electrode, and an electrolyte reservoir disposed between the first electrode and the second electrode, according to an embodiment.

FIG. 31 shows a schematic flow diagram of a method 500 of styling hair using a hair styling device that includes a first electrode, a second electrode spaced apart from the first electrode, and an electrolyte reservoir disposed between the first electrode and the second electrode. Such a hair styling device can include the apparatus 100, 200 or any other apparatus described herein. The method 200 includes disposing hair between the first electrode and the second electrode, at 502. The first electrode and the second electrode can include, for example the first electrode 110*a* and the second electrode 110*b* as described with respect to the apparatus 100. A volume of electrolyte is disposed on the hair and/or the electrolyte reservoir, at 504. For example, the hair can be sprayed or wetted with the electrolyte, or a volume of the electrolyte can be maintained between the first electrode and the second electrode by the electrolyte reservoir, for example, the electrolyte reservoir 129 as described with respect to the apparatus 100 or any other electrolyte reservoir described herein. In some embodiments, the electrolyte reservoir can include a porous material, a sponge, a solid electrolyte, or an electrolyte gel. The first electrode is biased at a first potential and the second electrode is biased at second potential to create an electrical potential difference between the first electrode and the second electrode and to produce an electrolysis zone in the electrolyte disposed between the first electrode and the second electrode, at 506. For example, in some embodiments, the first electrode can be polarized at a positive potential to serve as a cathode and the second electrode can be polarized at a negative potential to serve as an anode. In such embodiments, the electrolysis zone can include an alkaline and reducing zone proximate to the first electrode and an acidic and oxidizing zone proximate to the second electrode. The first electrode and the second electrode are moved through the hair to style the hair as it passes through the electrolysis zone between the first electrode and the second electrode, at 508. For example, the hair can be straightened, colored, bleached, moisturized, highlighted, or subjected to any other styling operating described herein. In some embodiments, the electrolyte reservoir can be a first electrolyte reservoir and the hair styling device can also include a second electrolyte reservoir. In such embodiments, the method 500 can also include transferring a replenishing volume of electrolyte from a second electrolyte reservoir to the first electrolyte reservoir. The second electrolyte reservoir can, for example, include the second electrolyte reservoir 240 or any other second electrolyte reservoir described herein. The second electrolyte reservoir can thus be used to maintain a constant volume of electrolyte in the first electrolyte reservoir to replace any electrolyte drained out from the first electrolyte reservoir into the hair, evaporated or decomposed during the styling of the hair.

Figure 32:
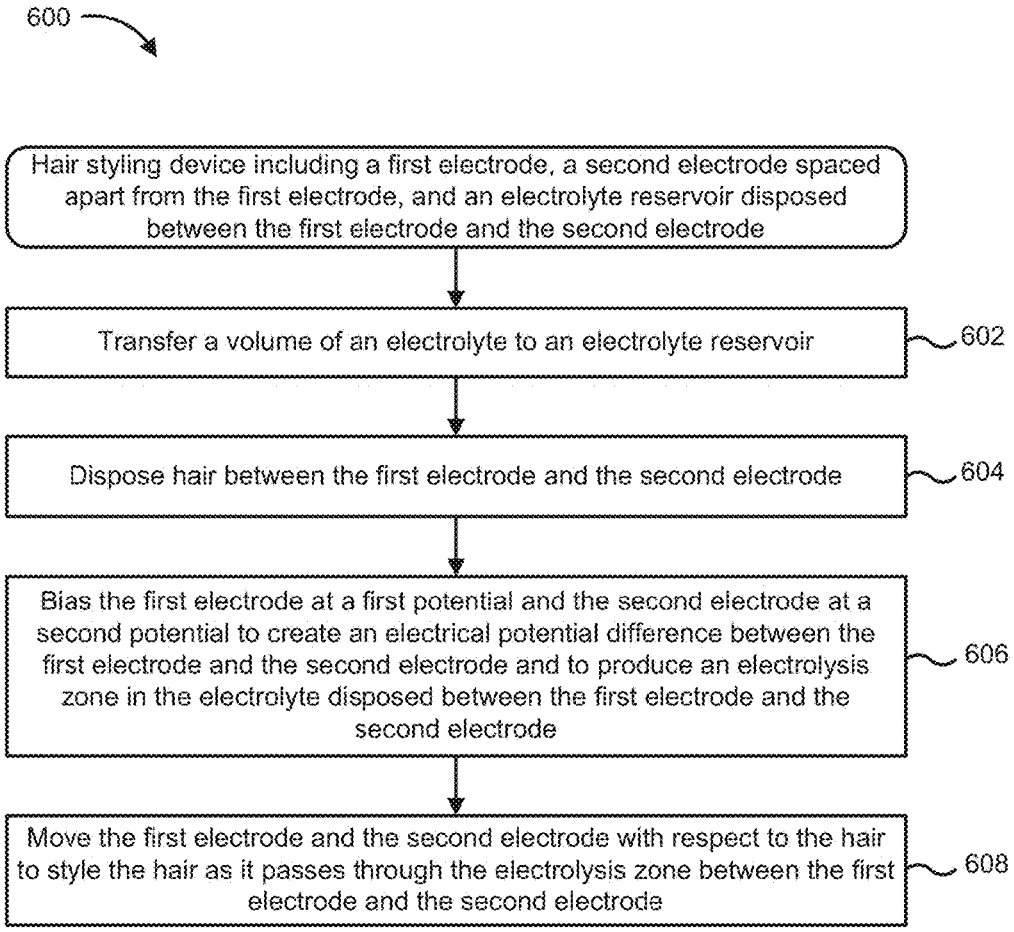
FIG. 32 is a schematic flow diagram of a method for styling hair using a hair styling device which includes a first electrode, a second electrode spaced apart from the first electrode, and an electrolyte reservoir disposed between the first electrode and the second electrode, and an electrolyte reservoir disposed between the first electrode and the second electrode, according to an embodiment.

In some embodiments, a method of styling hair using a hair styling device can include transferring an electrolyte to an electrolyte reservoir. For example, FIG. 32 shows a method 600 of styling hair using a hair styling device that includes a first electrode, a second electrode spaced apart from the first electrode, and an electrolyte reservoir disposed between the first electrode and the second electrode. Such a hair styling device can include the apparatus 100, 200 or any other apparatus described herein. The method 600 includes transferring a volume of an electrolyte to the electrolyte reservoir, at 602. For example, the electrolyte reservoir can be a first electrolyte reservoir and the hair styling device can include a second electrolyte reservoir (e.g., the second electrolyte reservoir 240 or any other second electrolyte reservoir described herein) configured to contain a volume of an electrolyte. The first electrolyte reservoir can include for example, a porous material, a sponge, a solid electrolyte or an electrolyte gel. The second electrolyte reservoir can be in fluidic communication with the first electrolyte reservoir, and configured to transfer a volume of the electrolyte to the first electrolyte reservoir.

The electrolyte can be transferred to the electrolyte reservoir using any suitable means. For example, in some embodiments, the electrolyte can be transferred to the electrolyte reservoir in response to a gravitational force and/or a capillary force. In some embodiments, the electrolyte can be transferred to the electrolyte reservoir using a pumping mechanism such as, for example, a manual pumping mechanism, or an automated pumping mechanism, as described herein.

The method 600 further includes disposing hair between the first electrode and the second electrode, at 604. The first electrode and the second electrode can include, for example the first electrode 110*a* and the second electrode 110*b* as described with respect to the apparatus 100. The first electrode is biased at a first potential and the second electrode is biased at second potential to create an electrical potential difference between the first electrode and the second electrode and to produce an electrolysis zone in the electrolyte disposed between the first electrode and the second electrode, at 606. For example, in some embodiments, the first electrode can be polarized at a positive potential to serve as a cathode and the second electrode can be polarized at a negative potential to serve as an anode. In such embodiments, the electrolysis zone can include an alkaline and reducing zone proximate to the first electrode and an acidic and oxidizing zone proximate to the second electrode. The first electrode and the second electrode are moved through the hair to style the hair as it passes through the electrolysis zone between the first electrode and the second electrode, at 608. For example, the hair can be straightened, colored, bleached, moisturized, highlighted, or subjected to any other styling operating described herein.

Figure 33:
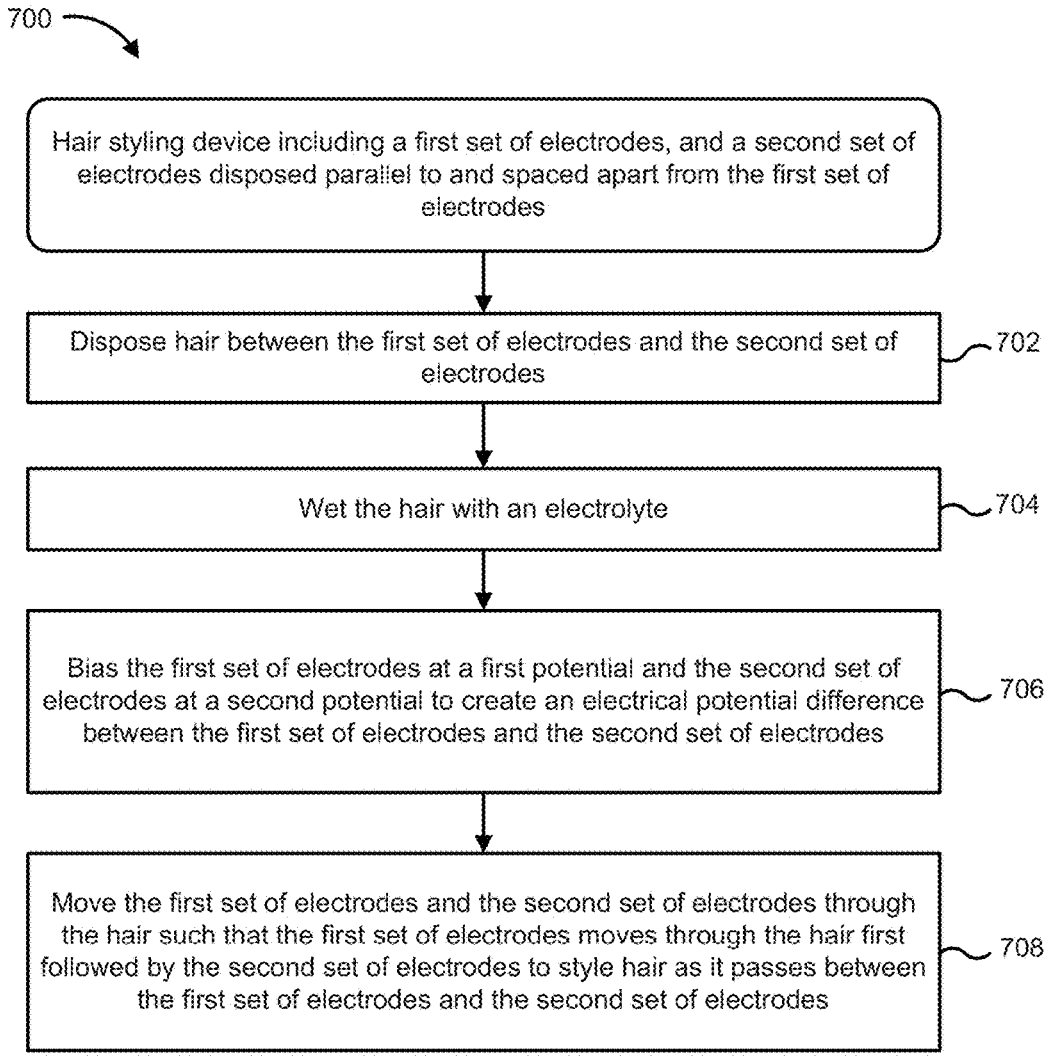
FIG. 33 is a schematic flow diagram of a method for styling hair using a hair styling device which includes a first set of electrodes, a second set of electrodes disposed parallel to and spaced apart from the first set of electrodes, and an electrolyte reservoir disposed between the first set of electrodes and the second set of electrodes, and an electrolyte reservoir disposed between the first set of electrodes and the second set of electrodes, according to an embodiment.

In some embodiments, the hair can be styled using an apparatus which includes a first set of electrodes of one polarity and a second set of electrodes of a second polarity. FIG. 33 shows a schematic flow diagram of a method 700 of styling hair using a hair styling device that includes a first set of electrodes, a second set of electrodes disposed parallel to and spaced apart from the first set of electrodes, and wetting the hair with an electrolyte. Such a hair styling device can include the apparatus 100, 200 or any other apparatus described herein. The method 700 includes disposing hair between the first set of electrodes and the second set of electrodes, at 702. The first set of electrodes and the second set of electrodes can include, for example the first set of electrodes 210*a* and the second set of electrodes 210*b*, as described with respect to the apparatus 200. In some embodiments, a volume of electrolyte is maintained between the first set of electrodes and the second set of electrodes, at 704. In other embodiments, the hair is wetted, e.g., sprayed, with an electrolyte and no reservoir of electrolyte is needed. For example, in some embodiments, a volume of the electrolyte can be maintained between the first electrode and the second electrode by the electrolyte reservoir, for example, the electrolyte reservoir 229 as described with respect to the apparatus 200. In some embodiments, the electrolyte reservoir can include a porous material, a sponge, a solid electrolyte, or an electrolyte gel. The first set of electrodes are biased at a first potential and the second set of electrodes are biased at second potential to create an electrical potential difference between the first set of electrodes and the second set of electrodes and to produce an electrolysis zone in the electrolyte disposed between the first set of electrodes and the second set of electrodes, at 706. For example, in some embodiments, the first set of electrodes can be polarized at a positive potential to serve as cathodes and the second set of electrodes can be polarized at a negative potential to serve as anodes. In such embodiments, the electrolysis zone can include an alkaline and reducing zone proximate to the first set of electrodes and an acidic and oxidizing zone proximate to the second set of electrodes. The first set of electrodes and the second set of electrodes are moved through the hair such that the first set of electrodes move through the hair first followed by the second set of electrodes to style the hair as it passes through the electrolysis zone between the first set of electrodes and the second set of electrodes, at 708. For example, the hair can be straightened, colored, bleached, moisturized, highlighted, or subjected to any other styling operating described herein. In some embodiments, the electrolyte reservoir can be a first electrolyte reservoir and the hair styling device also includes a second electrolyte reservoir. In such embodiments, the method 700 can also include transferring a replenishing volume of the electrolyte from a second electrolyte reservoir to the first electrolyte reservoir. The second electrolyte reservoir can, for example, include the second electrolyte reservoir 240 or any other second electrolyte reservoir described herein. The second electrolyte reservoir can thus be used to maintain a constant volume of electrolyte in the first electrolyte reservoir to replace any electrolyte which can, for example, drained out from between the first set of electrodes and the second set of electrodes into the hair, evaporate, or get decomposed during the styling of the hair.

The following examples show hair that has been styled using the hair devices described herein. These examples are only for illustrative purposes and are not intended to limit the scope of the present disclosure.

EXAMPLE 1

Straightening Natural Curly Hair Apparatus

Figures 34A, 34B, 34C:
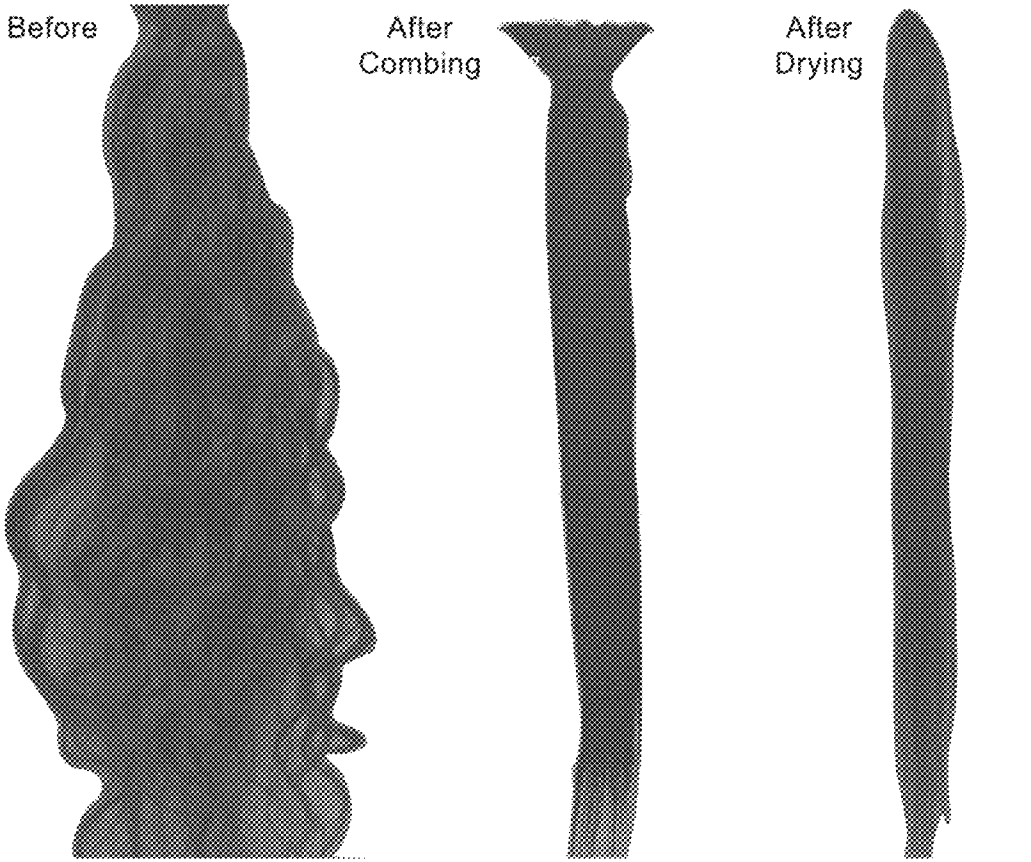
FIG. 34A shows a bundle of unstraightened hair.
FIG. 34B shows the hair straightened using the hair styling device of FIG. 2, and FIG. 34C the bundle of straightened hair after drying.

In this example, natural curly hair was straightened using the apparatus 200 for styling hair. FIG. 34A shows an optical image of natural curly hair before straightening with the apparatus 200. The hair styling device 200 is then used to comb the hair while performing electrolysis on the strands of hair. As shown in FIG. 34B, the curly hair remains straightened after combing with the hair styling device 200, and remains straight even after the hair is dried, i.e. the electrolyte is evaporated from the air as shown in FIG. 34C.

EXAMPLE 2

Curling Natural Straight Hair

Figure 35A:
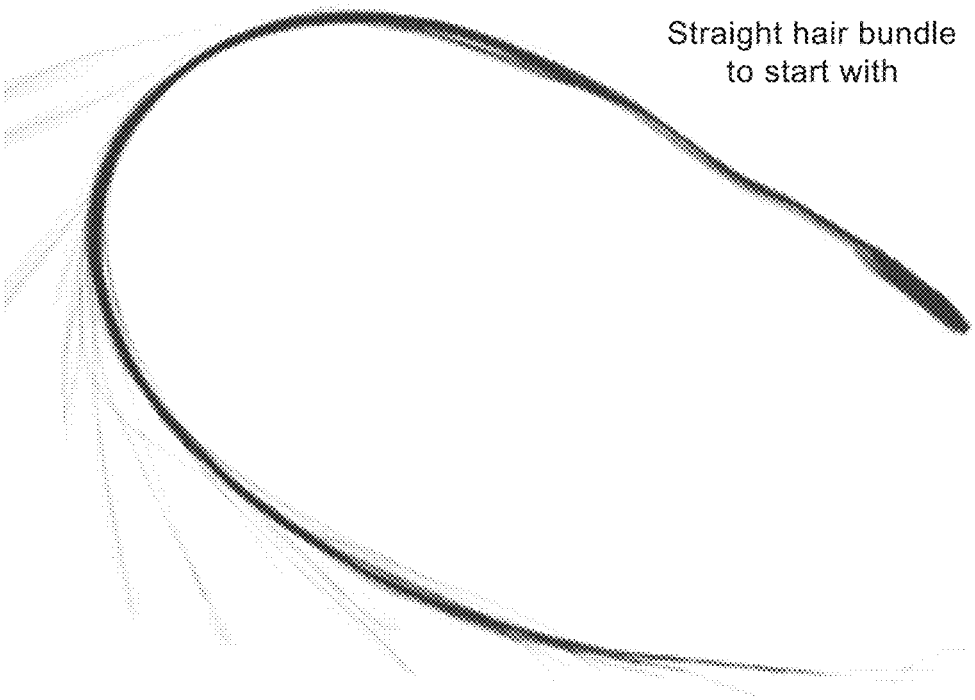
Figure 35B:
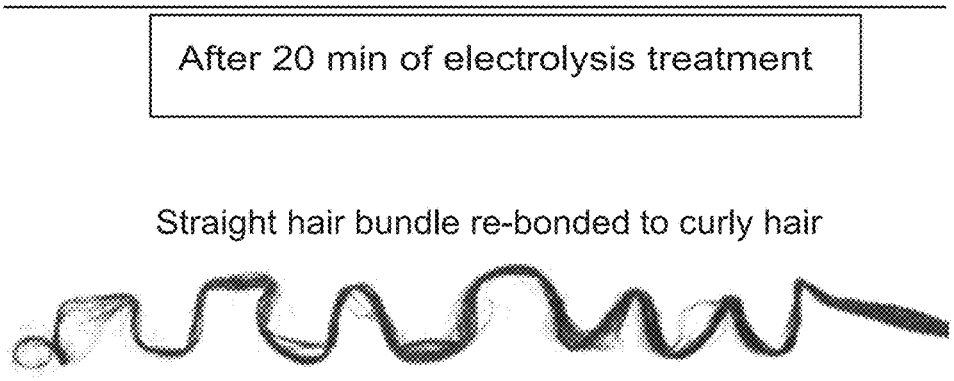
FIG. 35B shows a plurality of curls introduced into the bundle of straight hair using the hair styling device of FIG. 28.

In this example, curls were imparted in a natural straight strand of hair using the hair styling device 300. A straight hair bundle shown in FIG. 35A was wrapped around the first electrode 310*a* of the hair styling device 300, as described herein. The second electrode 310*b* was slid over the first electrode 310*a* such that the two electrodes were coaxial, which were then immersed in an electrolyte. After about 20 minutes of electrolysis cycles, a substantial amount of curls were introduced into the straight hair bundle as shown in FIG. 35B.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above.

Where schematics and/or embodiments described above indicate certain components arranged in certain orientations or positions, the arrangement of components may be modified. Similarly, where methods and/or events described above indicate certain events and/or procedures occurring in certain order, the ordering of certain events and/or procedures may be modified. While the embodiments have been particularly shown and described, it will be understood that various changes in form and details may be made.

The invention claimed is:

1. An apparatus for styling hair, comprising;

a frame;

a first electrode coupled to the frame;

a second electrode coupled to the frame and spaced apart from the first electrode;

a control module electrically coupled to the first electrode and the second electrode, the control module operable to bias the first electrode at a first potential and the second electrode at a second potential to create an electrical potential difference between the first electrode and the second electrode, the electrical potential difference configured to produce an electrolysis zone in an electrolyte disposed between the first electrode and the second electrode; and an electrolyte reservoir disposed between the first electrode and the second electrode, the electrolyte reservoir including a porous material disposed and configured to maintain a volume of the electrolyte within the electrolysis zone, the electrolysis zone configured to straighten hair disposed in the electrolysis zone between the first electrode and the second electrode.

2. The apparatus of claim 1, wherein the electrolyte reservoir is a first electrolyte reservoir, the apparatus further comprising:

a second electrolyte reservoir configured to contain a replenishing volume of the electrolyte, the second electrolyte reservoir configured to be fluidically coupled to the first electrolyte reservoir to transfer at least a portion of the replenishing volume of electrolyte to the first electrolyte reservoir.

3. The apparatus of claim 2, wherein the second electrolyte reservoir is configured to be removably coupled to the apparatus.

4. The apparatus of claim 2, further comprising:

a supply mechanism configured to transfer the electrolyte from the second electrolyte reservoir to the first electrolyte reservoir.

5. The apparatus of claim 4, wherein the supply mechanism is configured to transfer at least a portion of the electrolyte from the second electrolyte reservoir to the first electrolyte reservoir in response to gravitational force.

6. The apparatus of claim 4, wherein the supply mechanism is configured to transfer at least a portion of the electrolyte from the second electrolyte reservoir to the first electrolyte reservoir in response to capillary force.

7. A method of styling hair with a hair styling device, the hair styling device including a first electrode coupled to a frame, a second electrode coupled to the frame and spaced apart from the first electrode, and an electrolyte reservoir disposed between the first electrode and the second electrode, the electrolyte reservoir including a porous material disposed and configured to maintain a volume of an electrolyte within an electrolysis zone, the method comprising:

disposing hair between the first electrode and the second electrode;

disposing the volume of the electrolyte on at least one of the hair and the electrolyte reservoir;

biasing the first electrode at a first potential and the second electrode at a second potential to create an electrical potential difference between the first electrode and the second electrode and to produce the electrolysis zone in the electrolyte disposed between the first electrode and the second electrode; and moving the first electrode and the second electrode with respect to the hair to straighten the hair as it passes through the electrolysis zone between the first electrode and the second electrode.

8. The method of claim 7, wherein the electrolyte reservoir is a first electrolyte reservoir, the method further comprising:

transferring a replenishing volume of electrolyte from a second electrolyte reservoir to the first electrolyte reservoir.

9. A method of styling hair with a hair styling device, the styling device including a first electrode coupled to a frame, a second electrode coupled to the frame and spaced apart from the first electrode, and an electrolyte reservoir disposed between the first electrode and the second electrode, the electrolyte reservoir including a porous material disposed and configured to maintain a volume of an electrolyte within the electrolysis zone, the method comprising:

transferring the volume of the electrolyte reservoir;

disposing hair between the first electrode and the second electrode and wetting the hair with an electrolyte;

biasing the first electrode at a first potential and the second electrode at a second potential to create an electrical potential difference between the first electrode and the second electrode and to produce the electrolysis zone in the electrolyte disposed between the first electrode and the second electrode; and moving the first electrode and the second electrode with respect to the hair to straighten the hair as it passes through the electrolysis zone between the first electrode and the second electrode.

10. The method of claim 9, wherein the volume of the electrolyte is transferred to the electrolyte reservoir in response to a gravitational force.

11. The method of claim 9, wherein the volume of the electrolyte is transferred to the electrolyte reservoir in response to capillary force.

12. An apparatus for styling hair, comprising:

a frame;

a first set of electrodes coupled to the frame;

a second set of electrodes coupled to the frame and disposed parallel to and spaced apart from the first set of electrodes, the first set of electrodes and the second set of electrodes configured to be moved through the hair such that the first set of electrodes moves through the hair first followed by the second set of electrodes;

an electrolyte reservoir disposed between the first set of electrodes and the second set of electrodes, the electrolyte reservoir including a porous material disposed and configured to maintain a volume of an electrolyte within an electrolysis zone; and a control module electrically coupled to the first set of electrodes and the second set of electrodes, the control module operable to bias the first set of electrodes at a first potential and the second set of electrodes at a second potential to create an electrical potential difference between the first set of electrodes and the second set of electrodes, the electrical potential difference configured to produce the electrolysis zone in the electrolyte disposed between the first set of electrodes and the second set of electrodes, and to straighten hair disposed between the first set of electrodes and the second set of electrodes.

13. The apparatus of claim 12, wherein the first set of electrodes is disposed in a first row and the second set of electrodes is disposed in a second row, the first row of electrodes having no electrodes of the second set and the second row of electrodes having no electrodes of the first set.

14. The apparatus of claim 12, wherein the first set of electrodes and the second set of electrodes include a plurality of teeth.

15. The apparatus of claim 12, further comprising:

a first set of guard combs disposed adjacent to the first set of electrodes; and a second set of guard combs disposed adjacent to the second set of electrodes, the first set of guard combs and the second set of guard combs each configured to prevent the first set of electrodes and the second set of electrodes from contacting the user.

16. The apparatus of claim 12, wherein the electrolyte reservoir is configured to maintain the volume of the electrolyte between the first set of electrodes and the second set of electrodes.

17. The apparatus of claim 12, wherein the control module is operable to adjust a magnitude of at least one of the first potential and the second potential to adjust an intensity of the electrolysis zone.

18. The apparatus of claim 12, wherein the control module is operable to reverse a polarity of the first potential and the second potential.

19. A method of styling hair with a hair styling device, the hair styling device including a first set of electrodes coupled to a frame, a second set of electrodes coupled to the frame and disposed parallel to and spaced apart from the first set of electrodes, and an electrolyte reservoir disposed between the first set of electrodes and the second set of electrodes, the electrolyte reservoir including a porous material disposed and configured to maintain a volume of an electrolyte within an electrolysis zone, the method comprising:

disposing hair between the first set of electrodes and the second set of electrodes;

wetting the hair with the electrolyte;

biasing the first set of electrodes at a first potential and the second set of electrodes at a second potential to create an electrical potential difference between the first set of electrodes and the second set of electrodes; and moving the first set of electrodes and the second set of electrodes through the hair such that the first set of electrodes moves through the hair first followed by the second set of electrodes to straightened the hair as it passes between the first set of electrodes and the second set of electrodes.

20. The method of claim 19, wherein the electrolyte reservoir is configured to maintain the volume of the electrolyte between the first set of electrodes and the second set of electrodes.

21. The method of claim 20, wherein the electrolyte reservoir is a first electrolyte reservoir, the method further comprising:

transferring a replenishing volume of the electrolyte from a second electrolyte reservoir to the first electrolyte reservoir.

22. The method of claim 19, wherein the first and second sets of electrodes are arranged in spaced parallel rows with a first row including electrodes of the first set having no electrodes of the second set, and a second row including electrodes of the second set having no electrodes of the first set.

23. The method of claim 19, wherein an insulator is disposed between adjacent electrodes of the first set and the second set.

* * * * *